US008248358B2

(12) United States Patent
Todorovich

(10) Patent No.: US 8,248,358 B2
(45) Date of Patent: Aug. 21, 2012

(54) ALTERING FRAME RATES IN A MEMS DISPLAY BY SELECTIVE LINE SKIPPING

(75) Inventor: Mark M. Todorovich, San Diego, CA (US)

(73) Assignee: QUALCOMM MEMS Technologies, Inc., San Diego, CA (US)

( * ) Notice: Subject to any disclaimer, the term of this patent is extended or adjusted under 35 U.S.C. 154(b) by 475 days.

(21) Appl. No.: 12/413,431

(22) Filed: Mar. 27, 2009

(65) Prior Publication Data

US 2010/0245338 A1 Sep. 30, 2010

(51) Int. Cl.
*G09G 3/36* (2006.01)

(52) U.S. Cl. ..... 345/100; 345/96; 345/98; 345/204

(58) Field of Classification Search ..... 345/87–100, 345/204, 211, 214
See application file for complete search history.

(56) References Cited

U.S. PATENT DOCUMENTS

| | | | | |
|---|---|---|---|---|
| 4,954,789 | A | 9/1990 | Sampsell | |
| 5,091,723 | A | 2/1992 | Kanno et al. | |
| 5,576,731 | A | 11/1996 | Whitby et al. | |
| 5,699,075 | A | 12/1997 | Miyamoto | |
| 5,784,189 | A | 7/1998 | Bozler et al. | |
| 5,838,484 | A | 11/1998 | Goosen | |
| 5,966,235 | A | 10/1999 | Walker et al. | |
| 6,040,937 | A | 3/2000 | Miles | |
| 6,100,872 | A | 8/2000 | Aratani et al. | |
| 6,574,033 | B1 | 6/2003 | Chui et al. | |
| 6,657,832 | B2 | 12/2003 | Williams et al. | |
| 6,674,562 | B1 | 1/2004 | Miles et al. | |
| 6,680,792 | B2 | 1/2004 | Miles | |
| 7,123,216 | B1 | 10/2006 | Miles | |
| 7,136,213 | B2 | 11/2006 | Chui | |
| 7,138,973 | B2 * | 11/2006 | Okafuji et al. | 345/98 |
| 7,161,728 | B2 | 1/2007 | Sampsell et al. | |
| 7,327,510 | B2 | 2/2008 | Cummings et al. | |
| 7,535,466 | B2 * | 5/2009 | Sampsell et al. | 345/204 |
| 8,035,599 | B2 * | 10/2011 | Credelle et al. | 345/96 |
| 2002/0036304 | A1 | 3/2002 | Ehmke et al. | |
| 2003/0085858 | A1 * | 5/2003 | Okafuji et al. | 345/87 |
| 2004/0058532 | A1 | 3/2004 | Miles et al. | |
| 2005/0012577 | A1 | 1/2005 | Pillans et al. | |
| 2006/0044298 | A1 | 3/2006 | Mignard et al. | |
| 2006/0066597 | A1 * | 3/2006 | Sampsell | 345/204 |
| 2006/0109236 | A1 | 5/2006 | Yamaguchi et al. | |
| 2007/0041079 | A1 | 2/2007 | Chui | |
| 2008/0111771 | A1 * | 5/2008 | Miller et al. | 345/76 |
| 2009/0058837 | A1 * | 3/2009 | Kim et al. | 345/204 |
| 2009/0122384 | A1 | 5/2009 | Felnhofer et al. | |
| 2010/0079421 | A1 | 4/2010 | Chui | |
| 2010/0238537 | A1 | 9/2010 | Felnhofer et al. | |
| 2010/0315696 | A1 | 12/2010 | Lee et al. | |

FOREIGN PATENT DOCUMENTS

| | | |
|---|---|---|
| EP | 1 640 953 | 3/2006 |

OTHER PUBLICATIONS

ISR and WO dated Oct. 27, 2010 in PCT/US10/028710.

(Continued)

*Primary Examiner* — Nitin Patel
(74) *Attorney, Agent, or Firm* — Knobbe Martens Olson & Bear LLP

(57) ABSTRACT

Systems and methods for improving frame rate in MEMS display devices are disclosed. Lines are selected for skipping during updates based on the desired frame rate and the visual effect of skipping the particular line.

40 Claims, 16 Drawing Sheets

OTHER PUBLICATIONS

Miles, MEMS-based interferometric modulator for display applications, Part of the SPIE Conference on Micromachined Devices and Components, vol. 3876, pp. 20-28 (1999).

Miles et al., 5.3: Digital Paper™: Reflective displays using interferometric modulation, SID Digest, vol. XXXI, 2000 pp. 32-35.

IPRP dated Jul. 1, 2011 in PCT/US10/028710.

* cited by examiner

| | | Column Output Signals | |
|---|---|---|---|
| | | + $V_{bias}$ | -$V_{bias}$ |
| Row Output Signals | 0 | Stable | Stable |
| | + ΔV | Relax | Actuate |
| | −ΔV | Actuate | Relax |

390

| | | | |
|---|---|---|---|
| LINES PER FRAME | 720 | 720 | 720 |
| REQUIRED FRAME RATE (fps) | 30 | 30 | 30 |
| ACTUAL LINE TIME (μs) | 100 | 75 | 50 |
| NUMBER OF LINES TO SKIP | 387 | 276 | 54 |

FIG. 13

ALTERING FRAME RATES IN A MEMS DISPLAY BY SELECTIVE LINE SKIPPING

BACKGROUND

1. Field of the Invention

The field relates to microelectromechanical systems (MEMS), and more particularly to methods and systems for operating MEMS display system.

2. Description of the Related Art

Microelectromechanical systems (MEMS) include micro mechanical elements, actuators, and electronics. Micromechanical elements may be created using deposition, etching, and or other micromachining processes that etch away parts of substrates and/or deposited material layers or that add layers to form electrical and electromechanical devices. One type of MEMS device is called an interferometric modulator. As used herein, the term interferometric modulator or interferometric light modulator refers to a device that selectively absorbs and/or reflects light using the principles of optical interference. In certain embodiments, an interferometric modulator may comprise a pair of conductive plates, one or both of which may be transparent and/or reflective in whole or part and capable of relative motion upon application of an appropriate electrical signal. In a particular embodiment, one plate may comprise a stationary layer deposited on a substrate and the other plate may comprise a metallic membrane separated from the stationary layer by an air gap. As described herein in more detail, the position of one plate in relation to another can change the optical interference of light incident on the interferometric modulator. Such devices have a wide range of applications, and it would be beneficial in the art to utilize and/or modify the characteristics of these types of devices so that their features can be exploited in improving existing products and creating new products that have not yet been developed.

SUMMARY

The system, method, and devices of the invention each have several aspects, no single one of which is solely responsible for its desirable attributes. Without limiting the scope of this invention, its more prominent features will now be discussed briefly. After considering this discussion, and particularly after reading the section entitled "Detailed Description of Preferred Embodiments" one will understand how the features of this invention provide advantages over other display devices.

One aspect includes a method of operating a bi-stable display that includes determining a drive schedule for a plurality of bi-stable display elements arranged in a plurality of rows and columns. During a display update at least one of the rows or columns is skipped based upon the determined drive schedule.

Another aspect includes a bi-stable display system. The system includes a display. The display includes a plurality bi-stable elements arranged in a plurality of rows and columns. The system also includes a processor configured to communicate with the display. The processor determines a drive schedule and skips at least one of the rows or columns during an update of the display based upon the determined drive schedule.

Finally, one aspect includes a another bi-stable display system. This system has means for displaying display data. The system also has means for determining a drive schedule for updating the display means and skipping at least one of the rows or columns during an update of the display means based upon the determined drive schedule.

BRIEF DESCRIPTION OF THE DRAWINGS

FIG. 13 is a table containing data related to determining the number of lines to be skipped.

DETAILED DESCRIPTION OF PREFERRED EMBODIMENTS

The following detailed description is directed to certain specific embodiments. However, the teachings herein can be applied in a multitude of different ways. In this description, reference is made to the drawings wherein like parts are designated with like numerals throughout. The embodiments may be implemented in any device that is configured to display an image, whether in motion (e.g., video) or stationary (e.g., still image), and whether textual or pictorial. More particularly, it is contemplated that the embodiments may be implemented in or associated with a variety of electronic devices such as, but not limited to, mobile telephones, wireless devices, personal data assistants (PDAs), hand-held or portable computers, GPS receivers/navigators, cameras, MP3 players, camcorders, game consoles, wrist watches, clocks, calculators, television monitors, flat panel displays, computer monitors, auto displays (e.g., odometer display, etc.), cockpit controls and/or displays, display of camera views (e.g., display of a rear view camera in a vehicle), electronic photographs, electronic billboards or signs, projectors, architectural structures, packaging, and aesthetic structures (e.g., display of images on a piece of jewelry). MEMS devices of similar structure to those described herein can also be used in non-display applications such as in electronic switching devices.

The invention provides systems and methods for increasing the effective frame rates of MEMS display devices by selectively skipping lines during frame updates. In one embodiment, the quantity and identity of lines are selected to minimize the visual artifacts. By increasing effective frame rate, MEMS display systems can be adapted for use with display data streams which require a fixed frame rate which exceeds the frame rate capability of the MEMS device under its current environmental conditions.

Figure 1:
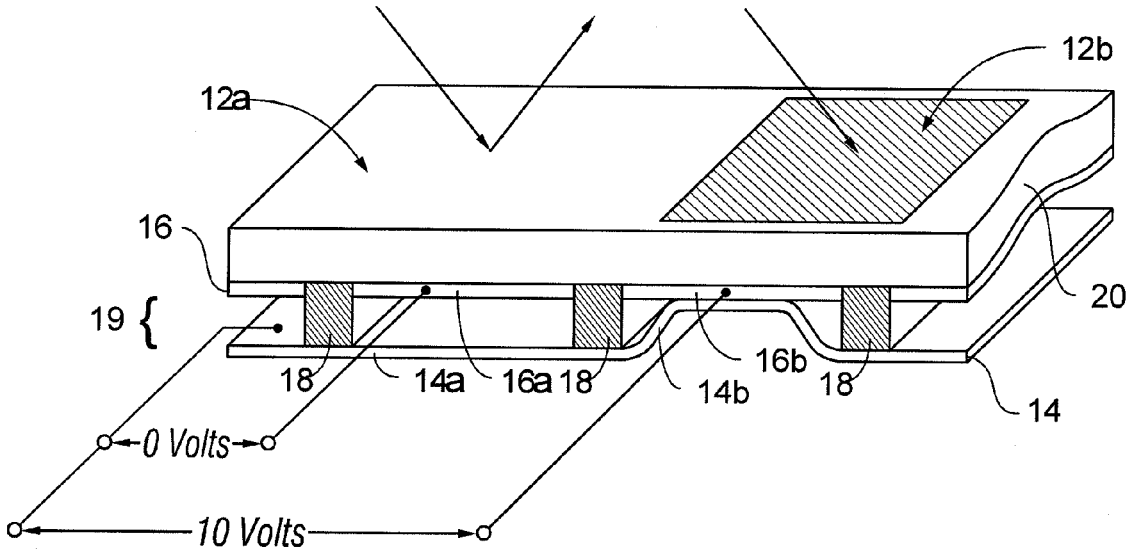
FIG. 1 is an isometric view depicting a portion of one embodiment of an interferometric modulator display in which a movable reflective layer of a first interferometric modulator is in a relaxed position and a movable reflective layer of a second interferometric modulator is in an actuated position.

One interferometric modulator display embodiment comprising an interferometric MEMS display element is illustrated in FIG. 1. In these devices, the pixels are in either a bright or dark state. In the bright ("relaxed" or "open") state, the display element reflects a large portion of incident visible light to a user. When in the dark ("actuated" or "closed") state, the display element reflects little incident visible light to the user. Depending on the embodiment, the light reflectance properties of the "on" and "off" states may be reversed. MEMS pixels can be configured to reflect predominantly at selected colors, allowing for a color display in addition to black and white.

FIG. 1 is an isometric view depicting two adjacent pixels in a series of pixels of a visual display, wherein each pixel comprises a MEMS interferometric modulator. In some embodiments, an interferometric modulator display comprises a row/column array of these interferometric modulators. Each interferometric modulator includes a pair of reflective layers positioned at a variable and controllable distance from each other to form a resonant optical gap with at least one variable dimension. In one embodiment, one of the reflective layers may be moved between two positions. In the first position, referred to herein as the relaxed position, the movable reflective layer is positioned at a relatively large distance from a fixed partially reflective layer. In the second position, referred to herein as the actuated position, the movable reflective layer is positioned more closely adjacent to the partially reflective layer. Incident light that reflects from the two layers interferes constructively or destructively depending on the position of the movable reflective layer, producing either an overall reflective or non-reflective state for each pixel.

The depicted portion of the pixel array in FIG. 1 includes two adjacent interferometric modulators 12*a* and 12*b*. In the interferometric modulator 12*a* on the left, a movable reflective layer 14*a* is illustrated in a relaxed position at a predetermined distance from an optical stack 16*a*, which includes a partially reflective layer. In the interferometric modulator 12*b* on the right, the movable reflective layer 14*b* is illustrated in an actuated position adjacent to the optical stack 16*b*.

The optical stacks 16*a* and 16*b* (collectively referred to as optical stack 16), as referenced herein, typically comprise several fused layers, which can include an electrode layer, such as indium tin oxide (ITO), a partially reflective layer, such as chromium, and a transparent dielectric. The optical stack 16 is thus electrically conductive, partially transparent and partially reflective, and may be fabricated, for example, by depositing one or more of the above layers onto a transparent substrate 20. The partially reflective layer can be formed from a variety of materials that are partially reflective such as various metals, semiconductors, and dielectrics. The partially reflective layer can be formed of one or more layers of materials, and each of the layers can be formed of a single material or a combination of materials.

In some embodiments, the layers of the optical stack 16 are patterned into parallel strips, and may form row electrodes in a display device as described further below. The movable reflective layers 14*a*, 14*b* may be formed as a series of parallel strips of a deposited metal layer or layers (orthogonal to the row electrodes of 16*a*, 16*b*) to form columns deposited on top of posts 18 and an intervening sacrificial material deposited between the posts 18. When the sacrificial material is etched away, the movable reflective layers 14*a*, 14*b* are separated from the optical stacks 16*a*, 16*b* by a defined gap 19. A highly conductive and reflective material such as aluminum may be used for the reflective layers 14, and these strips may form column electrodes in a display device. Note that FIG. 1 may not be to scale. In some embodiments, the spacing between posts 18 may be on the order of 10-100 um, while the gap 19 may be on the order of <1000 Angstroms.

With no applied voltage, the gap 19 remains between the movable reflective layer 14*a* and optical stack 16*a*, with the movable reflective layer 14*a* in a mechanically relaxed state, as illustrated by the pixel 12*a* in FIG. 1. However, when a potential (voltage) difference is applied to a selected row and column, the capacitor formed at the intersection of the row and column electrodes at the corresponding pixel becomes charged, and electrostatic forces pull the electrodes together. If the voltage is high enough, the movable reflective layer 14 is deformed and is forced against the optical stack 16. A dielectric layer (not illustrated in this Figure) within the optical stack 16 may prevent shorting and control the separation distance between layers 14 and 16, as illustrated by actuated pixel 12*b* on the right in FIG. 1. The behavior is the same regardless of the polarity of the applied potential difference.

FIGS. 2 through 5 illustrate one exemplary process and system for using an array of interferometric modulators in a display application.

Figure 2:
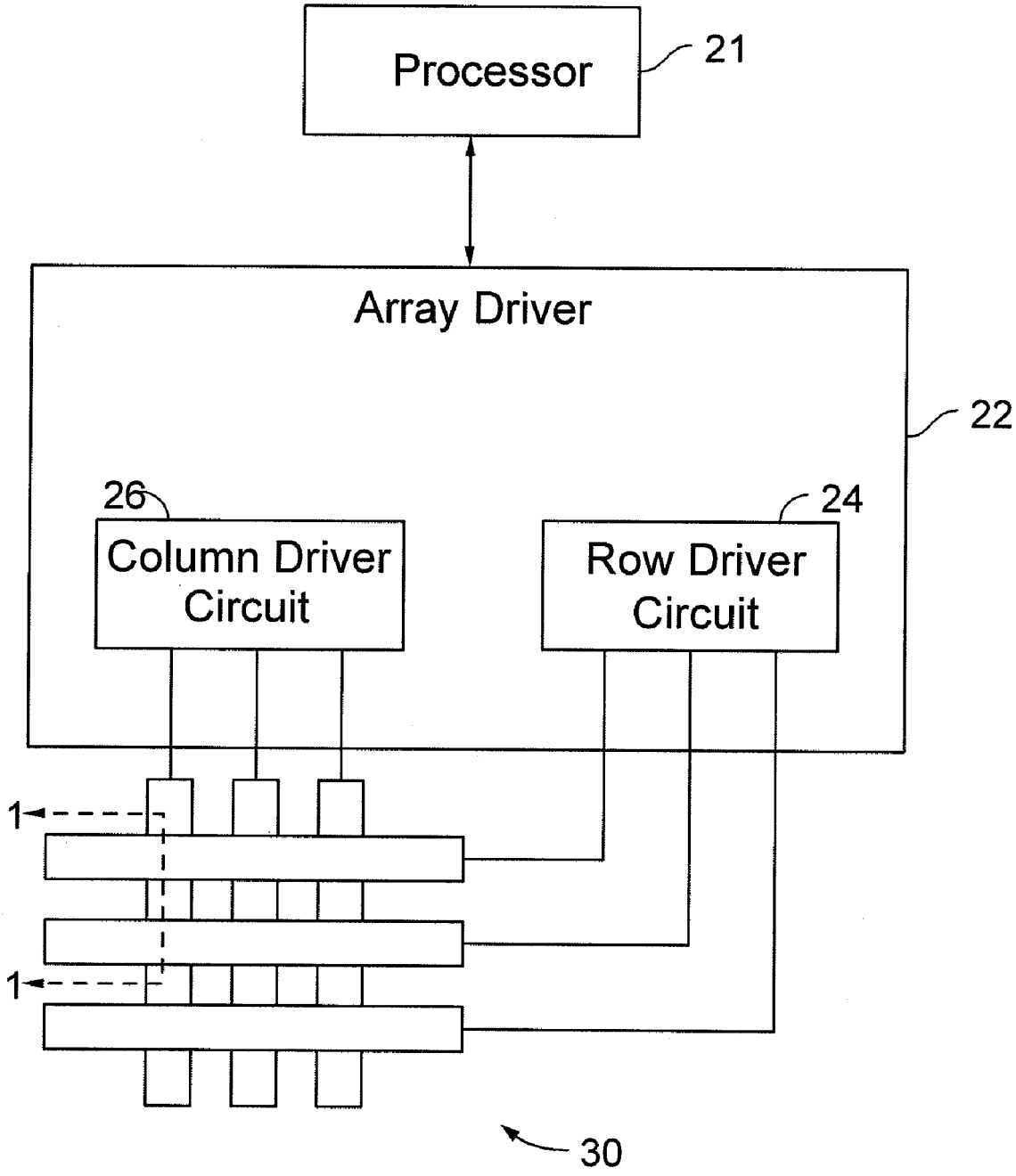
FIG. 2 is a system block diagram illustrating one embodiment of an electronic device incorporating a 3×3 interferometric modulator display.

FIG. 2 is a system block diagram illustrating one embodiment of an electronic device that may incorporate interferometric modulators. The electronic device includes a processor 21 which may be any general purpose single- or multi-chip microprocessor such as an ARM®, Pentium®, 8051, MIPS®, Power PC®, or ALPHA®, or any special purpose microprocessor such as a digital signal processor, microcontroller, or a programmable gate array. As is conventional in the art, the processor 21 may be configured to execute one or more software modules. In addition to executing an operating system, the processor may be configured to execute one or more software applications, including a web browser, a telephone application, an email program, or any other software application.

In one embodiment, the processor 21 is also configured to communicate with an array driver 22. In one embodiment, the array driver 22 includes a row driver circuit 24 and a column driver circuit 26 that provide signals to a display array or panel 30. The cross section of the array illustrated in FIG. 1 is shown by the lines 1-1 in FIG. 2. Note that although FIG. 2 illustrates a 3×3 array of interferometric modulators for the sake of clarity, the display array 30 may contain a very large number of interferometric modulators, and may have a different number of interferometric modulators in rows than in columns (e.g., 300 pixels per row by 190 pixels per column).

Figures 3, 4:
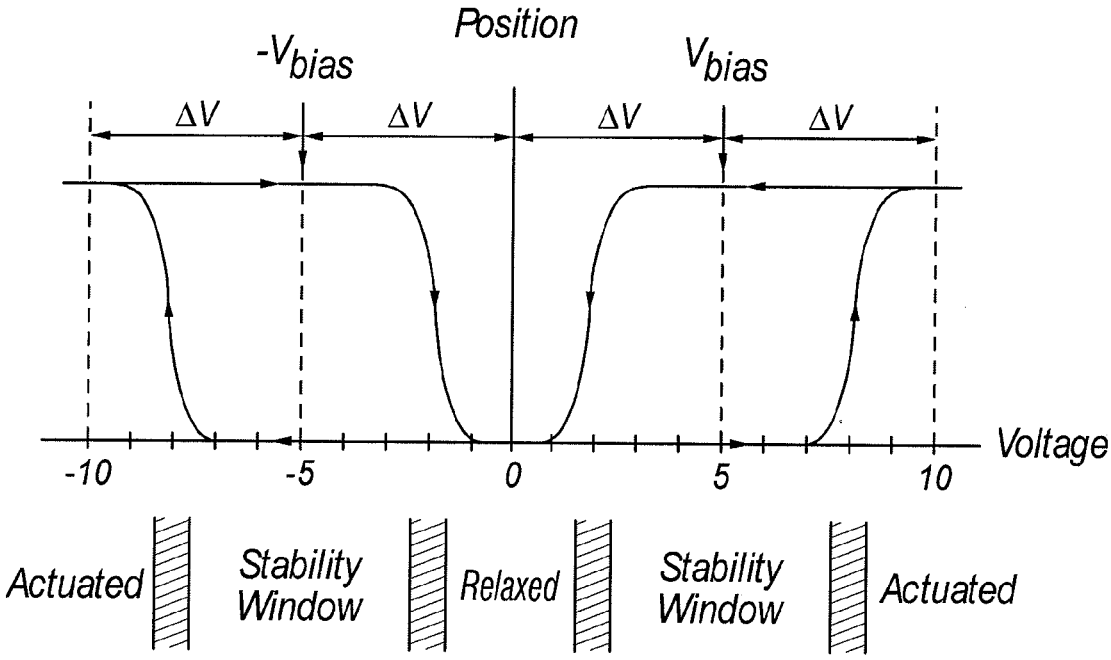
FIG. 3 is a diagram of movable mirror position versus applied voltage for one exemplary embodiment of an interferometric modulator of FIG. 1.
FIG. 4 is an illustration of a set of row and column voltages that may be used to drive an interferometric modulator display.

FIG. 3 is a diagram of movable mirror position versus applied voltage for one exemplary embodiment of an interferometric modulator of FIG. 1. For MEMS interferometric modulators, the row/column actuation protocol may take advantage of a hysteresis property of these devices as illustrated in FIG. 3. An interferometric modulator may require, for example, a 10 volt potential difference to cause a movable layer to deform from the relaxed state to the actuated state. However, when the voltage is reduced from that value, the movable layer maintains its state as the voltage drops back below 10 volts. In the exemplary embodiment of FIG. 3, the movable layer does not relax completely until the voltage drops below 2 volts. There is thus a range of voltage, about 3 to 7 V in the example illustrated in FIG. 3, where there exists a window of applied voltage within which the device is stable in either the relaxed or actuated state. This is referred to herein as the "hysteresis window" or "stability window." For a display array having the hysteresis characteristics of FIG. 3, the row/column actuation protocol can be designed such that during row strobing, pixels in the strobed row that are to be actuated are exposed to a voltage difference of about 10 volts, and pixels that are to be relaxed are exposed to a voltage difference of close to zero volts. After the strobe, the pixels are exposed to a steady state or bias voltage difference of about 5 volts such that they remain in whatever state the row strobe put them in. After being written, each pixel sees a potential difference within the "stability window" of 3-7 volts in this example. This feature makes the pixel design illustrated in FIG. 1 stable under the same applied voltage conditions in either an actuated or relaxed pre-existing state. Since each pixel of the interferometric modulator, whether in the actuated or relaxed state, is essentially a capacitor formed by the fixed and moving reflective layers, this stable state can be held at a voltage within the hysteresis window with almost no power dissipation. Essentially no current flows into the pixel if the applied potential is fixed.

As described further below, in typical applications, a frame of an image may be created by sending a set of data signals (each having a certain voltage level) across the set of column electrodes in accordance with the desired set of actuated pixels in the first row. A row pulse is then applied to a first row electrode, actuating the pixels corresponding to the set of data signals. The set of data signals is then changed to correspond to the desired set of actuated pixels in a second row. A pulse is then applied to the second row electrode, actuating the appropriate pixels in the second row in accordance with the data signals. The first row of pixels are unaffected by the second row pulse, and remain in the state they were set to during the first row pulse. This may be repeated for the entire series of rows in a sequential fashion to produce the frame. Generally, the frames are refreshed and/or updated with new image data by continually repeating this process at some desired number of frames per second. A wide variety of protocols for driving row and column electrodes of pixel arrays to produce image frames may be used.

FIGS. 4 and 5 illustrate one possible actuation protocol for creating a display frame on the 3×3 array of FIG. 2. FIG. 4 illustrates a possible set of column and row voltage levels that may be used for pixels exhibiting the hysteresis curves of FIG. 3. In the FIG. 4 embodiment, actuating a pixel involves setting the appropriate column to $-V_{bias}$, and the appropriate row to $+\Delta V$, which may correspond to −5 volts and +5 volts respectively Relaxing the pixel is accomplished by setting the appropriate column to $+V_{bias}$, and the appropriate row to the same $+\Delta V$, producing a zero volt potential difference across the pixel. In those rows where the row voltage is held at zero volts, the pixels are stable in whatever state they were originally in, regardless of whether the column is at $+V_{bias}$, or $-V_{bias}$. As is also illustrated in FIG. 4, voltages of opposite polarity than those described above can be used, e.g., actuating a pixel can involve setting the appropriate column to $+V_{bias}$, and the appropriate row to $-\Delta V$. In this embodiment, releasing the pixel is accomplished by setting the appropriate column to $-V_{bias}$, and the appropriate row to the same $-\Delta V$, producing a zero volt potential difference across the pixel.

Figure 5A:
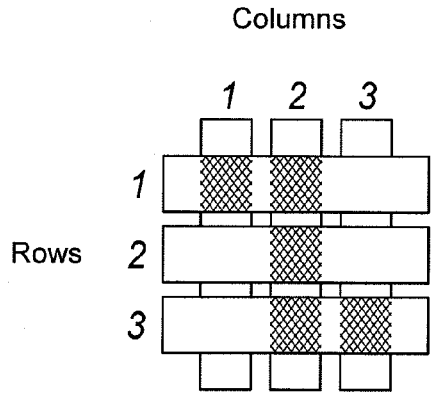
FIGS. 5A and 5B illustrate one exemplary timing diagram for row and column signals that may be used to write a frame of display data to the 3×3 interferometric modulator display of FIG. 2.
Figure 5B:
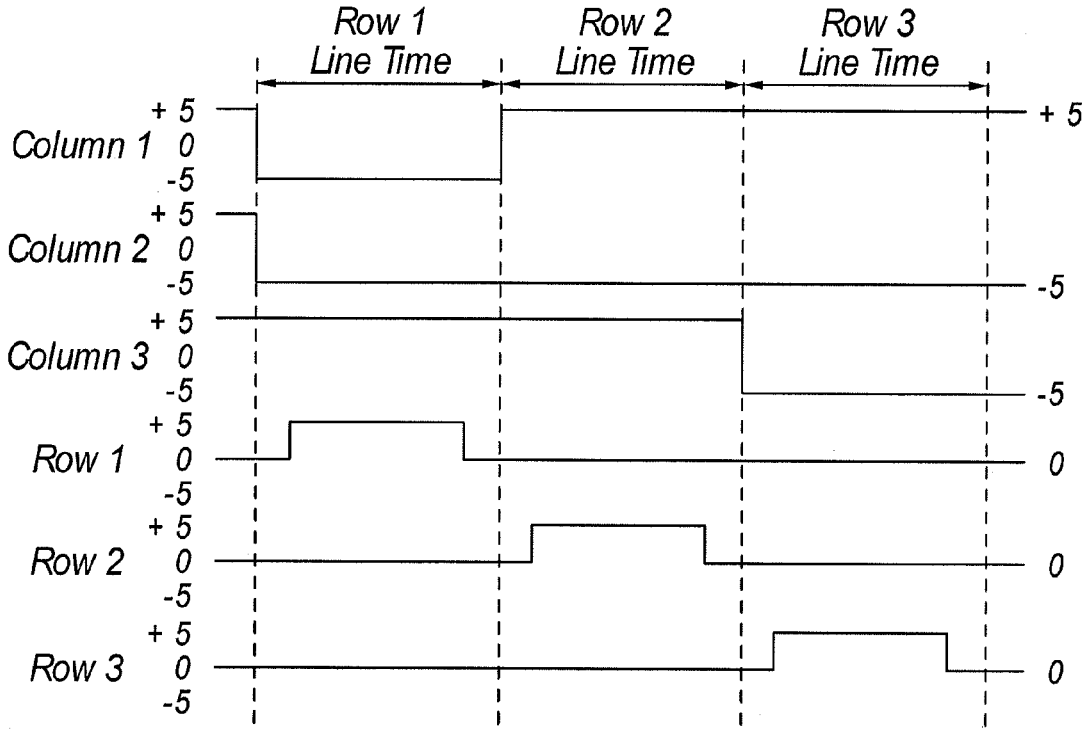

FIG. 5B is a timing diagram showing a series of row and column signals applied to the 3×3 array of FIG. 2 which will result in the display arrangement illustrated in FIG. 5A, where actuated pixels are non-reflective. Prior to writing the frame illustrated in FIG. 5A, the pixels can be in any state, and in this example, all the rows are initially at 0 volts, and all the columns are at +5 volts. With these applied voltages, all pixels are stable in their existing actuated or relaxed states.

In the FIG. 5A frame, pixels (1,1), (1,2), (2,2), (3,2) and (3,3) are actuated. To accomplish this, during a "line time" for row 1, columns 1 and 2 are set to −5 volts, and column 3 is set to +5 volts. This does not change the state of any pixels, because all the pixels remain in the 3-7 volt stability window. Row 1 is then strobed with a pulse that goes from 0, up to 5 volts, and back to zero. This actuates the (1,1) and (1,2) pixels and relaxes the (1,3) pixel. No other pixels in the array are affected. To set row 2 as desired, column 2 is set to −5 volts, and columns 1 and 3 are set to +5 volts. The same strobe applied to row 2 will then actuate pixel (2,2) and relax pixels (2,1) and (2,3). Again, no other pixels of the array are affected. Row 3 is similarly set by setting columns 2 and 3 to −5 volts, and column 1 to +5 volts. The row 3 strobe sets the row 3 pixels as shown in FIG. 5A. After writing the frame, the row potentials are zero, and the column potentials can remain at either +5 or −5 volts, and the display is then stable in the arrangement of FIG. 5A. The same procedure can be employed for arrays of dozens or hundreds of rows and columns. The timing, sequence, and levels of voltages used to perform row and column actuation can be varied widely within the general principles outlined above, and the above example is exemplary only, and any actuation voltage method can be used with the systems and methods described herein.

Figure 6A:
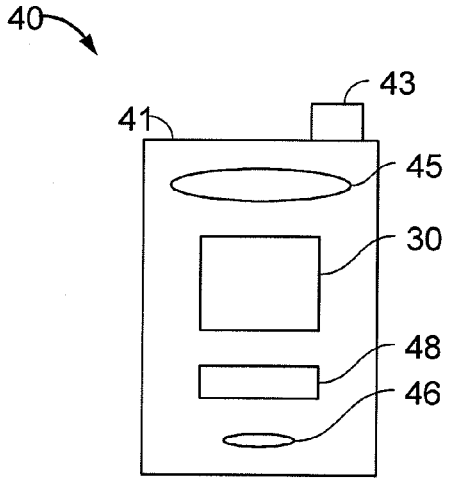
FIGS. 6A and 6B are system block diagrams illustrating an embodiment of a visual display device comprising a plurality of interferometric modulators.
Figure 6B:
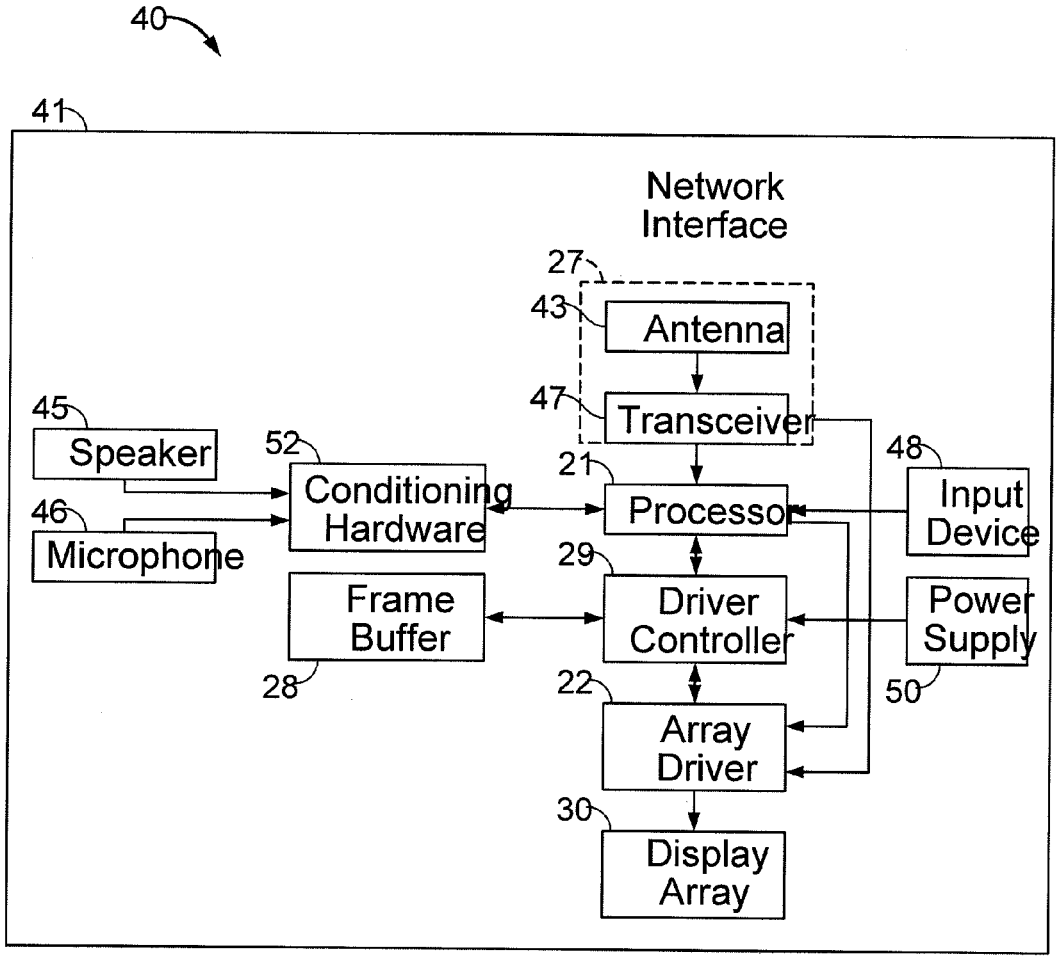

FIGS. 6A and 6B are system block diagrams illustrating an embodiment of a display device 40. The display device 40 can be, for example, a cellular or mobile telephone. However, the same components of display device 40 or slight variations thereof are also illustrative of various types of display devices such as televisions and portable media players.

The display device 40 includes a housing 41, a display 30, an antenna 43, a speaker 45, an input device 48, and a microphone 46. The housing 41 is generally formed from any of a variety of manufacturing processes, including injection molding, and vacuum forming. In addition, the housing 41 may be made from any of a variety of materials, including but not limited to plastic, metal, glass, rubber, and ceramic, or a combination thereof. In one embodiment the housing 41 includes removable portions (not shown) that may be interchanged with other removable portions of different color, or containing different logos, pictures, or symbols.

The display 30 of exemplary display device 40 may be any of a variety of displays, including a bi-stable display, as described herein. In other embodiments, the display 30 includes a flat-panel display, such as plasma, EL, OLED, STN LCD, or TFT LCD as described above, or a non-flat-panel display, such as a CRT or other tube device. However, for purposes of describing the present embodiment, the display 30 includes an interferometric modulator display, as described herein.

The components of one embodiment of exemplary display device 40 are schematically illustrated in FIG. 6B. The illustrated exemplary display device 40 includes a housing 41 and can include additional components at least partially enclosed therein. For example, in one embodiment, the exemplary display device 40 includes a network interface 27 that includes an antenna 43 which is coupled to a transceiver 47. The transceiver 47 is connected to a processor 21, which is connected to conditioning hardware 52. The conditioning hardware 52 may be configured to condition a signal (e.g. filter a signal). The conditioning hardware 52 is connected to a speaker 45 and a microphone 46. The processor 21 is also connected to an input device 48 and a driver controller 29. The driver controller 29 is coupled to a frame buffer 28, and to an array driver 22, which in turn is coupled to a display array 30. A power supply 50 provides power to all components as required by the particular exemplary display device 40 design.

The network interface 27 includes the antenna 43 and the transceiver 47 so that the exemplary display device 40 can communicate with one or more devices over a network. In one embodiment the network interface 27 may also have some processing capabilities to relieve requirements of the processor 21. The antenna 43 is any antenna for transmitting and receiving signals. In one embodiment, the antenna transmits and receives RF signals according to the IEEE 802.11 standard, including IEEE 802.11(a), (b), or (g). In another embodiment, the antenna transmits and receives RF signals according to the BLUETOOTH standard. In the case of a cellular telephone, the antenna is designed to receive CDMA, GSM, AMPS, W-CDMA, or other known signals that are used to communicate within a wireless cell phone network. The transceiver 47 pre-processes the signals received from the antenna 43 so that they may be received by and further manipulated by the processor 21. The transceiver 47 also processes signals received from the processor 21 so that they may be transmitted from the exemplary display device 40 via the antenna 43.

In an alternative embodiment, the transceiver 47 can be replaced by a receiver. In yet another alternative embodiment, network interface 27 can be replaced by an image source, which can store or generate image data to be sent to the processor 21. For example, the image source can be a digital video disc (DVD) or a hard-disc drive that contains image data, or a software module that generates image data.

Processor 21 generally controls the overall operation of the exemplary display device 40. The processor 21 receives data, such as compressed image data from the network interface 27 or an image source, and processes the data into raw image data or into a format that is readily processed into raw image data. The processor 21 then sends the processed data to the driver controller 29 or to frame buffer 28 for storage. Raw data typically refers to the information that identifies the image characteristics at each location within an image. For example, such image characteristics can include color, saturation, and gray-scale level.

In one embodiment, the processor 21 includes a microcontroller, CPU, or logic unit to control operation of the exemplary display device 40. Conditioning hardware 52 generally includes amplifiers and filters for transmitting signals to the speaker 45, and for receiving signals from the microphone 46. Conditioning hardware 52 may be discrete components within the exemplary display device 40, or may be incorporated within the processor 21 or other components.

The driver controller 29 takes the raw image data generated by the processor 21 either directly from the processor 21 or from the frame buffer 28 and reformats the raw image data appropriately for high speed transmission to the array driver 22. Specifically, the driver controller 29 reformats the raw image data into a data flow having a raster-like format, such that it has a time order suitable for scanning across the display array 30. Then the driver controller 29 sends the formatted information to the array driver 22. Although a driver controller 29, such as a LCD controller, is often associated with the system processor 21 as a stand-alone Integrated Circuit (IC), such controllers may be implemented in many ways. They may be embedded in the processor 21 as hardware, embedded in the processor 21 as software, or fully integrated in hardware with the array driver 22.

Typically, the array driver 22 receives the formatted information from the driver controller 29 and reformats the video data into a parallel set of waveforms that are applied many times per second to the hundreds and sometimes thousands of leads coming from the display's x-y matrix of pixels.

In one embodiment, the driver controller 29, array driver 22, and display array 30 are appropriate for any of the types of displays described herein. For example, in one embodiment, driver controller 29 is a conventional display controller or a bi-stable display controller (e.g., an interferometric modulator controller). In another embodiment, array driver 22 is a conventional driver or a bi-stable display driver (e.g., an interferometric modulator display). In one embodiment, a driver controller 29 is integrated with the array driver 22. Such an embodiment is common in highly integrated systems such as cellular phones, watches, and other small area displays. In yet another embodiment, display array 30 is a typical display array or a bi-stable display array (e.g., a display including an array of interferometric modulators).

The input device 48 allows a user to control the operation of the exemplary display device 40. In one embodiment, input device 48 includes a keypad, such as a QWERTY keyboard or a telephone keypad, a button, a switch, a touch-sensitive screen, a pressure- or heat-sensitive membrane. In one embodiment, the microphone 46 is an input device for the exemplary display device 40. When the microphone 46 is used to input data to the device, voice commands may be provided by a user for controlling operations of the exemplary display device 40.

Power supply 50 can include a variety of energy storage devices as are well known in the art. For example, in one embodiment, power supply 50 is a rechargeable battery, such as a nickel-cadmium battery or a lithium ion battery. In another embodiment, power supply 50 is a renewable energy source, a capacitor, or a solar cell, including a plastic solar cell, and solar-cell paint. In another embodiment, power supply 50 is configured to receive power from a wall outlet.

In some implementations control programmability resides, as described above, in a driver controller which can be located in several places in the electronic display system. In some cases control programmability resides in the array driver 22. The above-described optimization may be implemented in any number of hardware and/or software components and in various configurations.

Figure 7A:
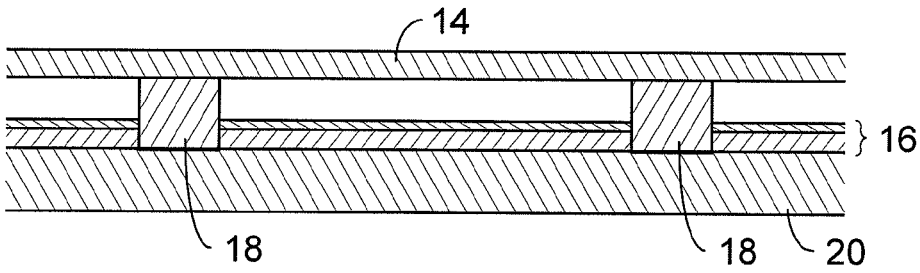
FIG. 7A is a cross section of the device of FIG. 1.
Figure 7B:
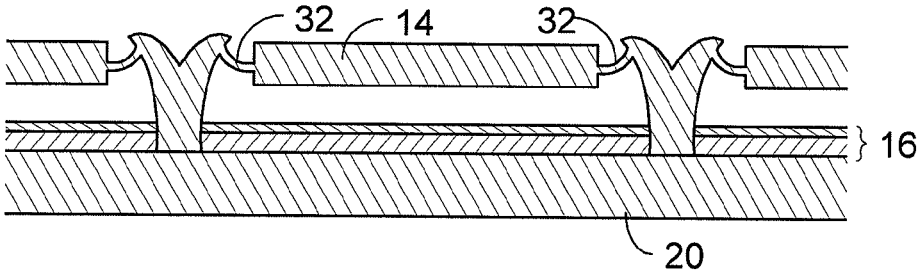
FIG. 7B is a cross section of an alternative embodiment of an interferometric modulator.
Figure 7C:
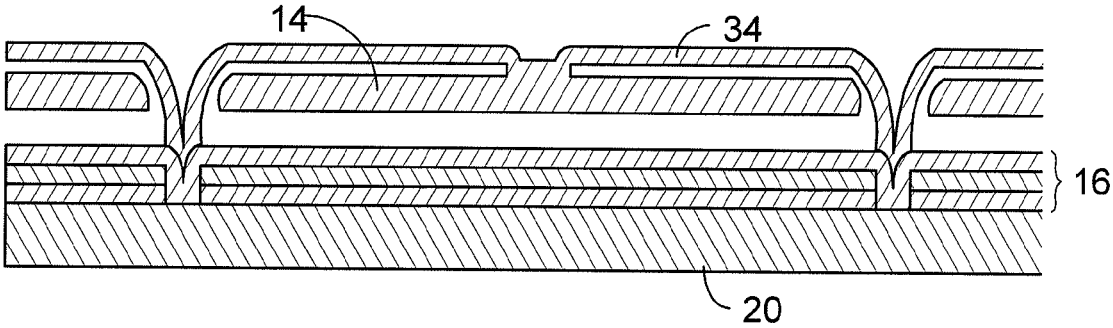
FIG. 7C is a cross section of another alternative embodiment of an interferometric modulator.
Figure 7D:
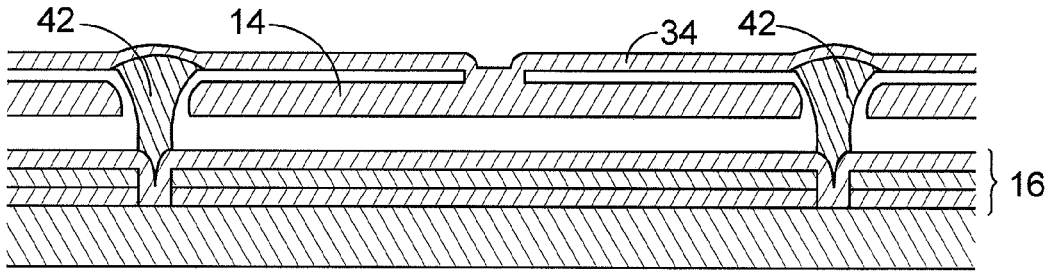
FIG. 7D is a cross section of yet another alternative embodiment of an interferometric modulator.
Figure 7E:
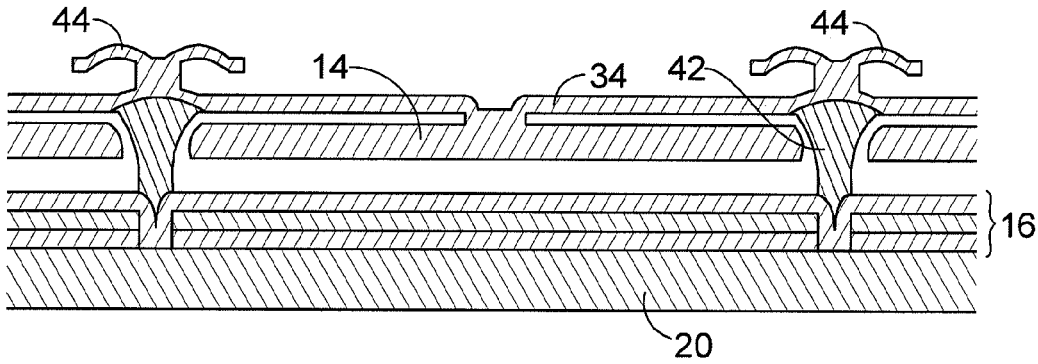
FIG. 7E is a cross section of an additional alternative embodiment of an interferometric modulator.

The details of the structure of interferometric modulators that operate in accordance with the principles set forth above may vary widely. For example, FIGS. 7A-7E illustrate five different embodiments of the movable reflective layer 14 and its supporting structures. FIG. 7A is a cross section of the embodiment of FIG. 1, where a strip of metal material 14 is deposited on orthogonally extending supports 18. In FIG. 7B, the moveable reflective layer 14 of each interferometric modulator is square or rectangular in shape and attached to supports at the corners only, on tethers 32. In FIG. 7C, the moveable reflective layer 14 is square or rectangular in shape and suspended from a deformable layer 34, which may comprise a flexible metal. The deformable layer 34 connects, directly or indirectly, to the substrate 20 around the perimeter of the deformable layer 34. These connections are herein referred to as support posts. The embodiment illustrated in FIG. 7D has support post plugs 42 upon which the deformable layer 34 rests. The movable reflective layer 14 remains suspended over the gap, as in FIGS. 7A-7C, but the deformable layer 34 does not form the support posts by filling holes between the deformable layer 34 and the optical stack 16. Rather, the support posts are formed of a planarization material, which is used to form support post plugs 42. The embodiment illustrated in FIG. 7E is based on the embodiment shown in FIG. 7D, but may also be adapted to work with any of the embodiments illustrated in FIGS. 7A-7C as well as additional embodiments not shown. In the embodiment shown in FIG. 7E, an extra layer of metal or other conductive material has been used to form a bus structure 44. This allows signal routing along the back of the interferometric modulators, eliminating a number of electrodes that may otherwise have had to be formed on the substrate 20.

In embodiments such as those shown in FIG. 7, the interferometric modulators function as direct-view devices, in which images are viewed from the front side of the transparent substrate 20, the side opposite to that upon which the modulator is arranged. In these embodiments, the reflective layer 14 optically shields the portions of the interferometric modulator on the side of the reflective layer opposite the substrate 20, including the deformable layer 34. This allows the shielded areas to be configured and operated upon without negatively affecting the image quality. For example, such shielding allows the bus structure 44 in FIG. 7E, which provides the ability to separate the optical properties of the modulator from the electromechanical properties of the modulator, such as addressing and the movements that result from that addressing. This separable modulator architecture allows the structural design and materials used for the electromechanical aspects and the optical aspects of the modulator to be selected and to function independently of each other. Moreover, the embodiments shown in FIGS. 7C-7E have additional benefits deriving from the decoupling of the optical properties of the reflective layer 14 from its mechanical properties, which are carried out by the deformable layer 34. This allows the structural design and materials used for the reflective layer 14 to be optimized with respect to the optical properties, and the structural design and materials used for the deformable layer 34 to be optimized with respect to desired mechanical properties.

FIGS. 8-16 describe embodiments of systems and methods for operating a bi-stable display system. While some of the embodiments will specifically be described in terms of bi-stable MEMS devices or a MEMS display, it will be appreciated by one of skill in the art that these methods and systems may be implemented with other bi-stable display technologies. For ease of explanation, a MEMS display will be described as consisting of a plurality of rows and columns. Alternatively, rows may be referred to as lines. The set of rows and columns will collectively be described as a display matrix or matrix. It will be appreciated that rows and columns are interchangeable and that the systems and methods herein may be practiced in conjunction with MEMS displays in arranged in different orientations. Similarly, display data will be described as consisting of lines. One line of display data corresponds to a row or line of the display matrix. Display data will also be described as consisting of frames. One frame of display data corresponds to N lines of display data where N is the number of rows in the matrix. In one embodiment, display data is displayed on the matrix by updating or refreshing individual rows sequentially. The amount of time required to update an individual row may be referred to as a line time. The amount of time required to update the entire matrix may be referred to as a frame time. Alternatively, the frame time may be expressed as a number of frames per second and referred to as a frame rate. The physical properties of a particular MEMS display, in conjunction with environmental conditions and other factors, may result in a range of frame rates at which the particular MEMS display is capable of operating. For simplicity, this range of frame rates at which a particular MEMS display can operate may be referred to as the frame rate of the MEMS display. Alternatively, this range may be referred to as the display update rate or display update rate capability of the MEMS display. In another alternative, this range may be referred to as the actual display update rate to distinguish it from the desired display update rate described below. Display data may be designed to be displayed at a particular frame rate. For example, video data may be designed to be displayed at a frame rate of 30 frames per second. However, the characteristics of an individual MEMS display system may not permit the display device to achieve this frame rate. For example, the line time and the number of lines for a particular display may be high enough to cause the frame rate of the display to be lower than 30 frames per second. Attempting to display a fixed rate display data input stream on a display with a frame rate lower than the fixed rate can cause visual artifacts such as skipping and tearing that degrade the user experience. In certain embodiments, systems and methods are provided for ameliorating the visual artifacts caused by attempting to display a display data stream with a frame rate greater than the display rate of the display device.

Figure 8:
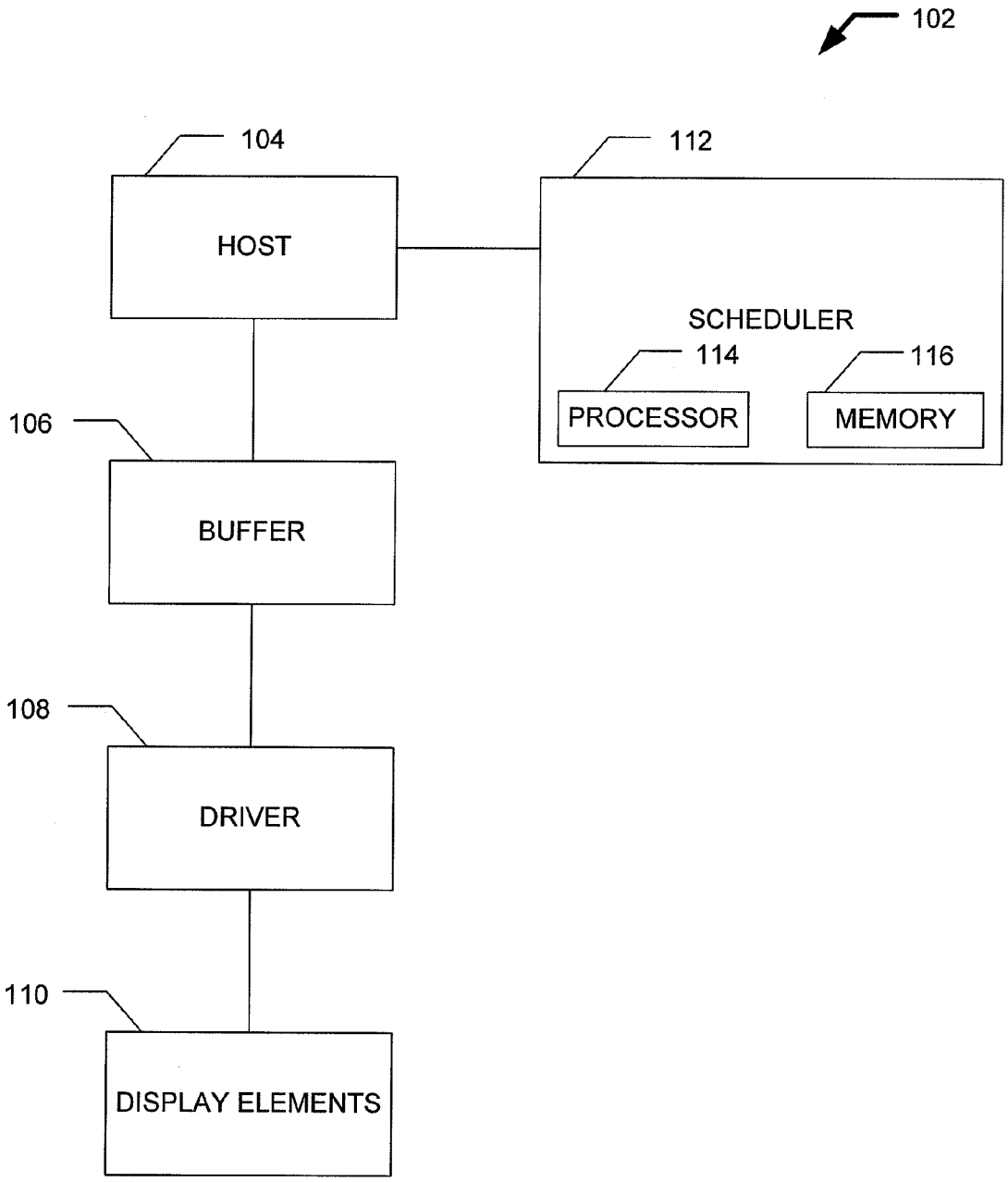
FIG. 8 is a system block diagram illustrating one embodiment of a MEMS display system.

FIG. 8 is a functional block diagram of a MEMS display system 102. In addition to new features, system 102 illustrates portions of system 40 from FIG. 6A-B. For ease of explanation, several of the functional blocks described in FIG. 6B have been incorporated into a single functional block identified as host 104. In particular, host 104 may include the functionality of processor 21, driver controller 29, and conditioning hardware 52. Further, buffer 106 is similar in functionality to frame buffer 28, driver 108 is similar to array driver 22, and display elements 110 are similar to display array 30. In function, host 104 transfers display data to buffer 106. Buffer 106 stores display data from host 104 until driver 108 is ready to display said data. Driver 108 retrieves display data from buffer 106 and causes display elements 110 to display said data. In one embodiment, display elements 110 are a plurality of MEMS devices organized into rows and columns. This arrangement is similar to the rows and columns illustrated in FIG. 2 and its accompanying text. MEMS display system 102 also has scheduler 112 communicatively connected with host 104. Scheduler 112 has processor 114 and memory 116. In one embodiment, scheduler 112 operates in conjunction with host 104 to select a subset of the display data which is then stored to buffer 106. As described before, the display data received by host 104 may require a frame rate greater than the frame rate that driver 108 and display elements 110 can achieve. Scheduler 112 operates to create a drive schedule. In one embodiment, the drive schedule comprises a set of lines of display data that can be skipped during a particular frame update. In another embodiment, the drive schedule comprises a set of lines to be updated during a particular frame update. By updating according to the drive schedule and skipping one or more lines during the update, the effective frame rate of display system 102 is increased. Further, since the display elements 110 are MEMS devices, they are bi-stable, and retain their characteristics when skipped. This bi-stable characteristic allows the systems and methods herein to develop drive schedules which, in addition to increasing frame rate, minimize visual artifacts. The number of lines to skip and the process by which certain lines are selected for skipping will be described in greater detail below. In one embodiment, the lines that are not scheduled to be skipped are written to buffer 106 such that driver 108 can display all lines retrieved from the buffer without determining whether the retrieved lines are to be skipped. It will be appreciated that constituent elements of system 102 have been illustrated as functionally separate. However, in practice one or more of host 104, buffer 106, driver 108, and scheduler 112, may share common physical resources such as processing or memory capabilities.

Figure 9:
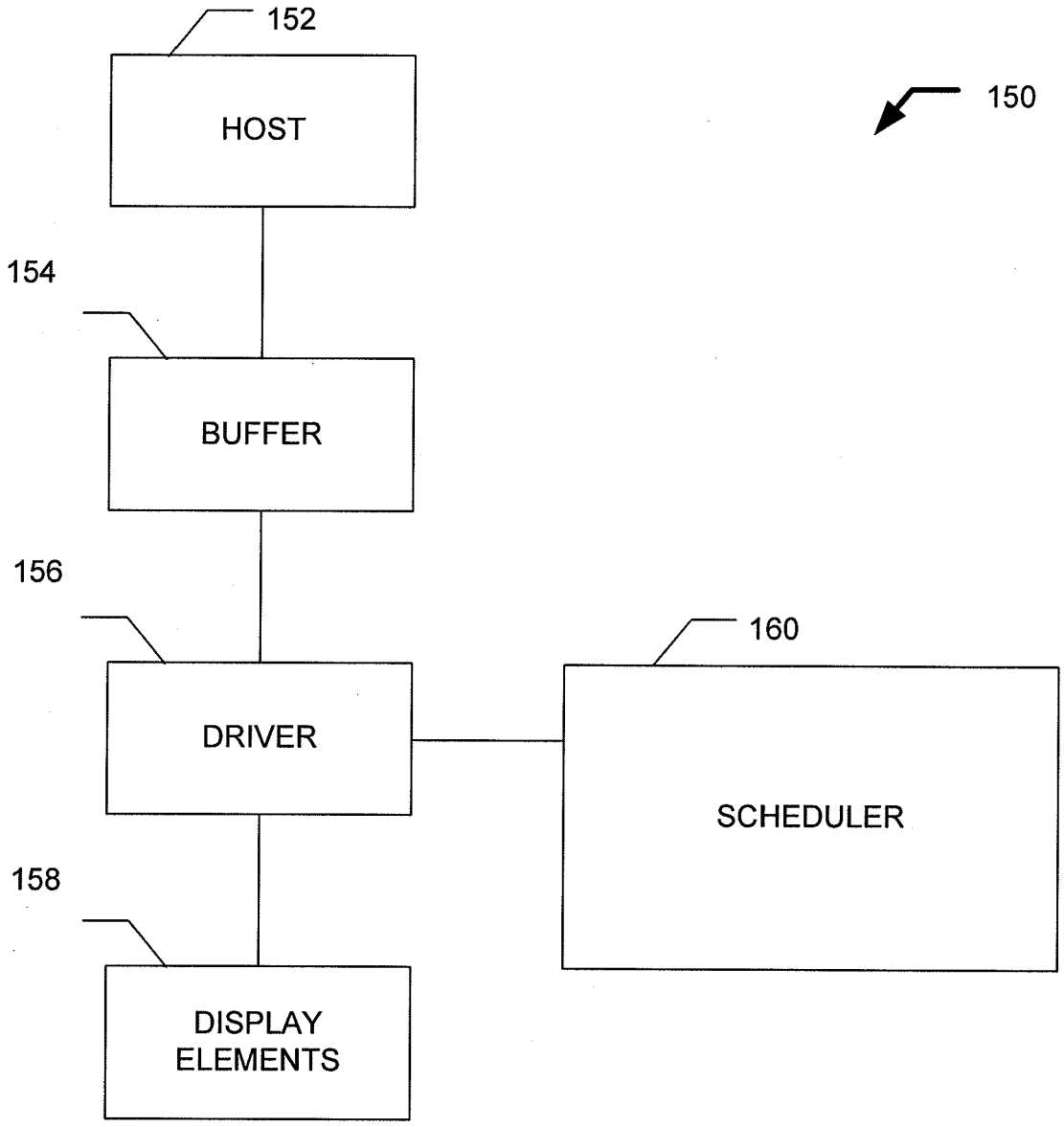
FIG. 9 is a system block diagram illustrating another embodiment of a MEMS display system.

FIG. 9 is a functional block diagram of another MEMS display system 150. Display system 150 is similar to system 102 of FIG. 8. With respect to FIG. 8, scheduler 112 operates in conjunction with the host 104 to select the lines to be skipped before the lines are written to the buffer 106. However, with respect to FIG. 9, system 150 has scheduler 160 communicatively connected to driver 156. Scheduler 160 operates to select a set of lines to be skipped from the lines retrieved from buffer 154 by driver 156. In system 150, host 152 can operate without directly interfacing with scheduler 160.

Figure 10:
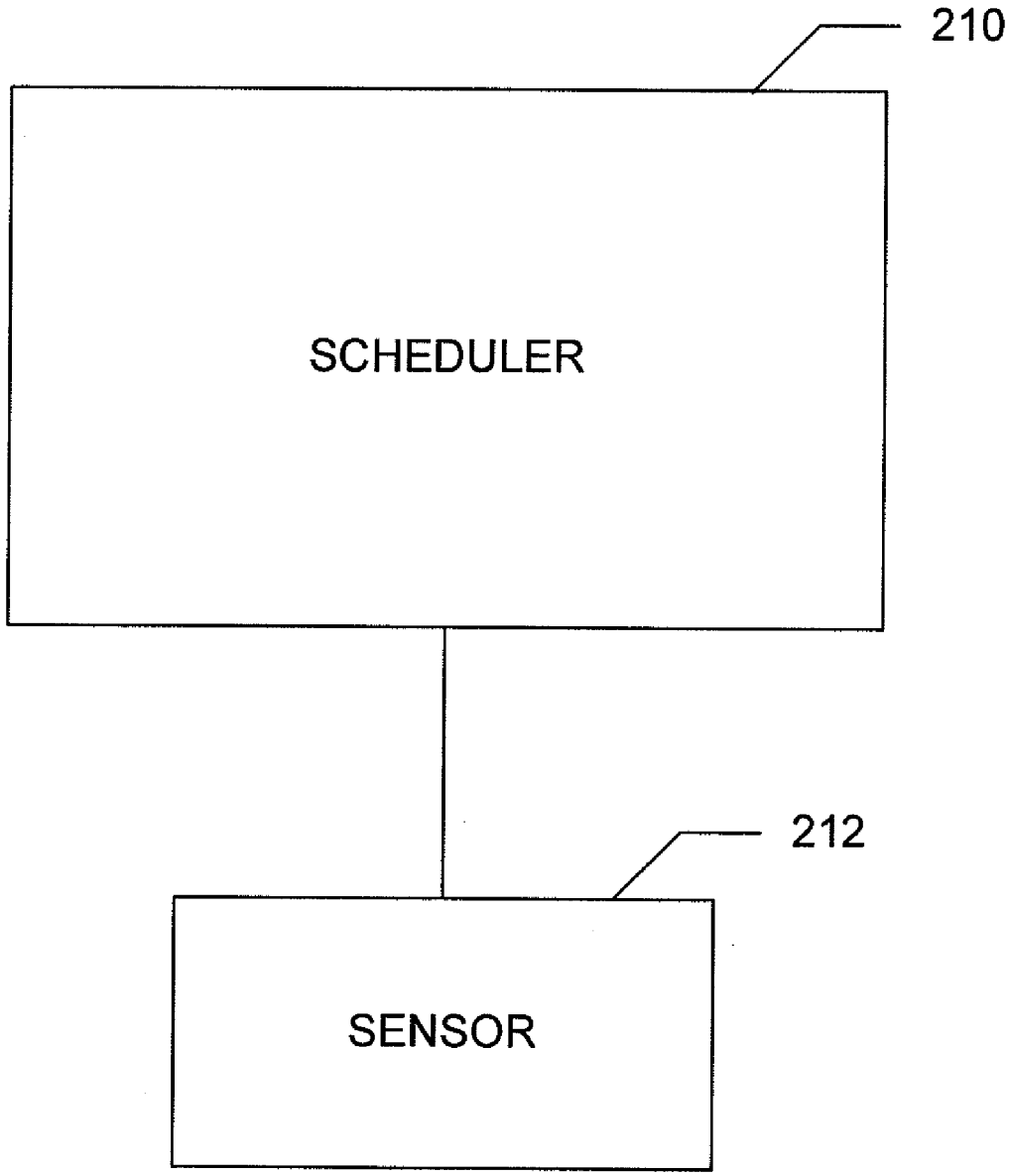
FIG. 10 is a system block diagram illustrating one embodiment of a scheduler.

FIG. 10 is a functional block diagram of another embodiment of a scheduler 210. Scheduler 210 may be representative of scheduler 112 in FIG. 8 or scheduler 160 of FIG. 9. Scheduler 210 is communicatively connected to a sensor 212. Sensor 212 is configurable to measure physical parameters such as, but not limited to, temperature, humidity, and atmospheric pressure. The actual line time of a MEMS display device can vary with certain physical parameters. For example, temperature of the system may affect line time. In this embodiment, scheduler 210 is communicatively connected to sensor 212 so that it can receive information regarding physical parameters that may affect line time. As described below, scheduler 210 may use information gathered from sensor 212 in determining how many and which lines to skip.

Figure 11A:
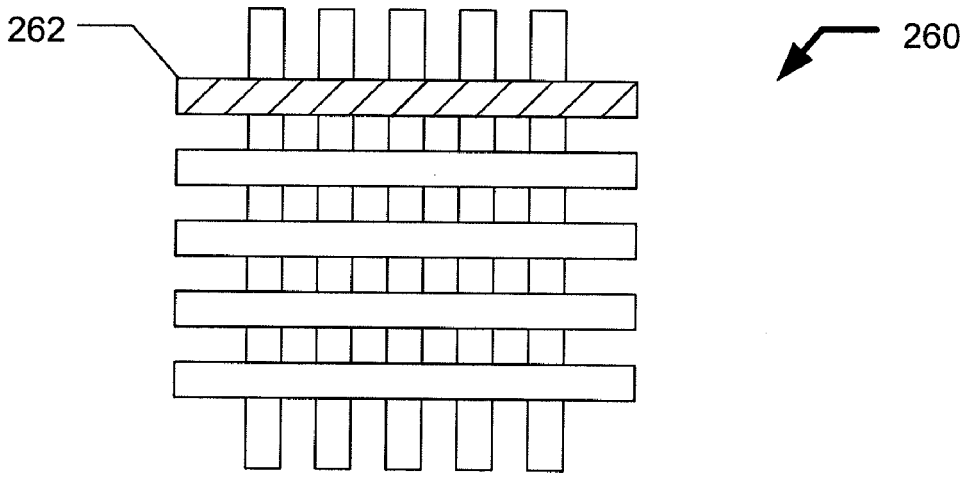
FIG. 11A-C are illustrations of sequential updates of a MEMS display device.
Figure 11B:
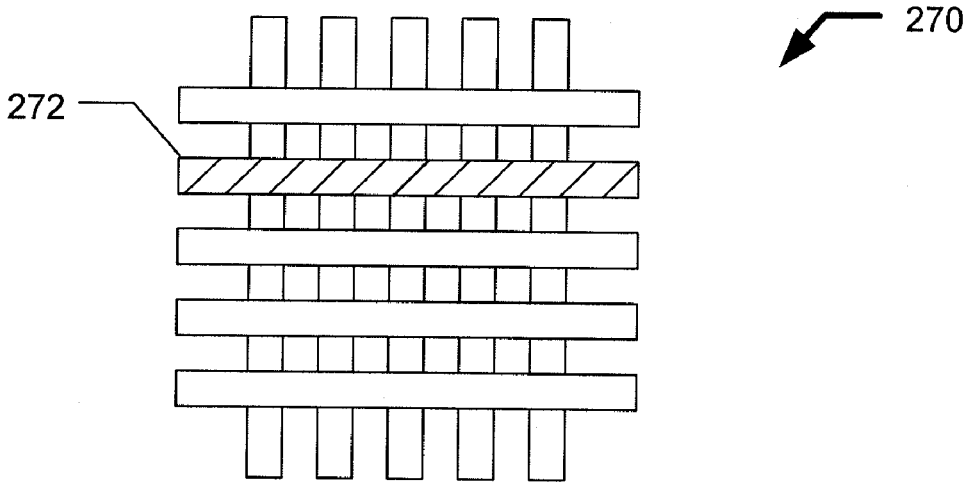
Figure 11C:
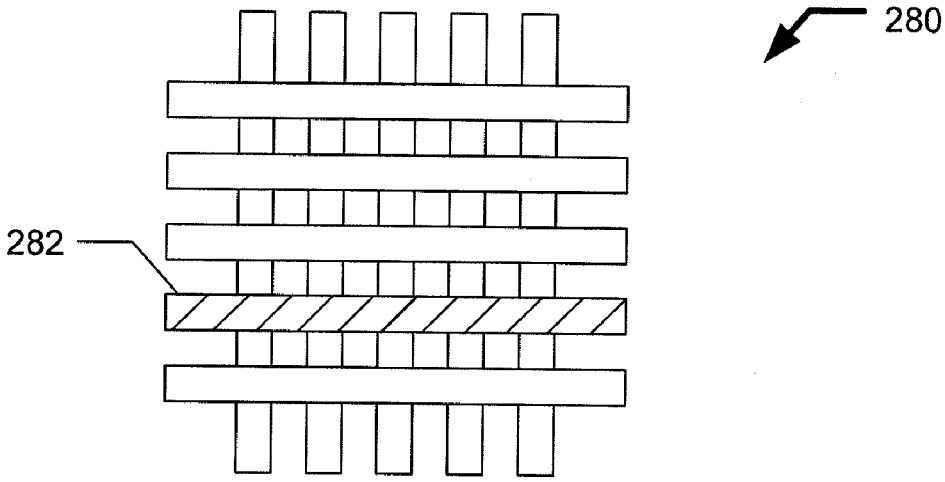

FIGS. 11A-C illustrate a MEMS display during sequential frame updates according to embodiments herein described. For ease in explanation, FIGS. 11A-C will be described in relation to FIG. 8. In this respect, FIGS. 11A-C represent display elements 110. FIG. 11A illustrates five rows and columns of MEMS devices organized as a matrix 260. For the purposes of explanation, it assumed that a display data input stream requiring a display rate of one frame per second is received. Further it is assumed that the line time for lines in matrix 260 is 0.25 seconds. With a line time of 0.25 seconds and 5 lines, the frame rate of matrix 260 is 0.8 frames per second. Since matrix 260 has a frame rate that is lower than the frame rate of the display data input stream, display system 102 cannot accommodate the display input stream under normal operation. In certain embodiments, systems and methods are provided for selecting both the number and identity of lines to skip to both meet required frame rates and preserve the quality of user experience. For example, in FIG. 11A, during a particular frame update, skipping the update on line 262 has the least negative visual effect. Further, in FIG. 11B, on a subsequent update, line 272 is skipped with negligible visual detriment. Finally, in FIG. 11C, during another frame update, line 282 is skipped without degrading user experience. Skipping one line per frame update increases the effective frame rate of the display to one frame per second. Further, by selecting the identity of lines to skip according to predetermined visual criteria, greater operational frame rates can be achieved without sacrificing the quality of the user experience.

Figure 12:
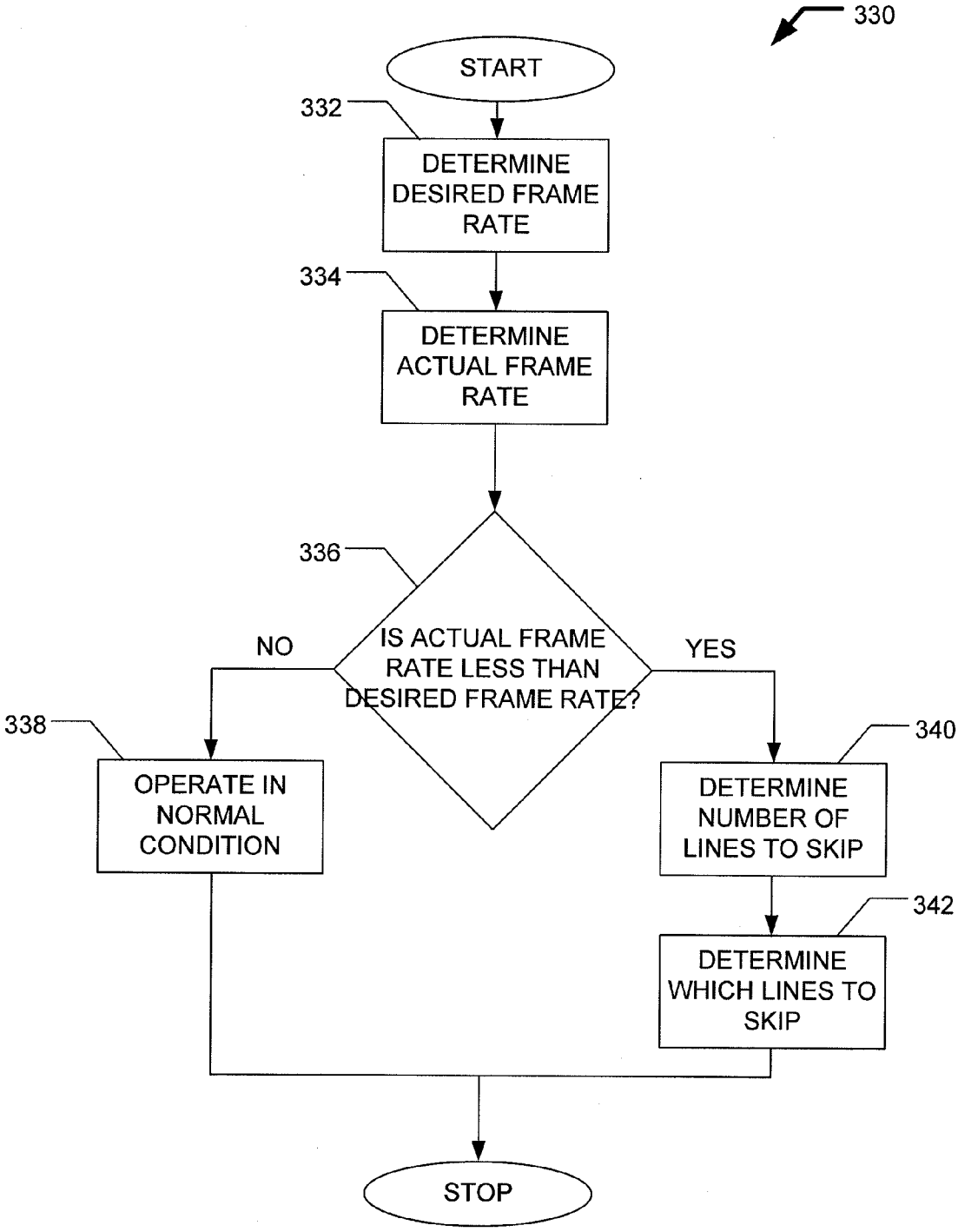
FIG. 12 is a block diagram illustrating one embodiment of a method for selectively skipping lines to increase frame rate.

FIG. 12 is a flowchart illustrating one method for selecting lines to skip in order to increase effective frame rates. Depending on the embodiment, other steps may be added, certain steps removed, the steps rearranged, multiple steps be merged into a single step, or single steps broken into substeps. For purposes of explanation, method 330 will be described in relation to display system 102 of FIG. 8. However, it will be appreciated that method of FIG. 12 may be practiced with system 150 of FIG. 9 or other embodiments herein described. First, in step 332 the scheduler 112 determines the desired frame rate for the display elements 110. In one example, the desired frame rate may be the frame rate required by the display data input stream received by host 104. For example, if a stream of video data requiring a display rate of 30 frames per second is received by host 104, the desired frame rate may be equal or greater to 30 frames per second. Next, in step 334 the scheduler 112 determines the actual frame rate of the display elements 110. The actual frame rate describes the baseline operation of the display elements. In one example, this entails updating every line during each frame update. However, in other examples, baseline operation might entail skipping one or more lines for other reasons such as conserving power. As described herein, this actual frame rate may be measured directly or approximated based on certain parameters. Further, while the actual frame rate is referenced, the actual line time may be similarly used for the purposes described herein. One of skill in the art would understand the relationship between line time and frame rate. However, actual frame rate is used herein for ease in comparing a fixed frame rate data stream with the frame rate of the display device 102. Continuing to decision step 336, scheduler 112 makes a decision responsive to a comparison of the actual frame rate and the desired frame rate. If the desired frame rate is less than the actual frame rate, the display device 102, as described in step 338, operates in its normal condition. In this example, that entails updating every line during every frame update. However, if the actual frame rate is less than the desired frame rate, the method proceeds to step 340. In step 340 the scheduler 112 determines the number of lines to skip. This calculation may be responsive to factors including, but not limited to, the number of lines in the frame, the line time, and the desired frame rate. For example, the number of lines to skip may be determined according to the equation 1 below:

$$(\text{Lines to Skip})=(\text{Lines per Frame})-(\text{Required Frame Rate})^{-1}(\text{Actual Line Time})^{-1} \qquad \text{Equation (1)}$$

Where:

Lines to Skip is the number of rows that will not be updated during a particular display update.

Lines per Frame is the number of rows of the display matrix or the number of lines in a frame of display data.

Required Frame Rate is the desired effective frame rate for display updates.

Actual Line Time is the measured or estimated time required to update a row of the display matrix.

FIG. 13 further illustrates sample calculations for the number of lines to be skipped given different line times. After determining the number of lines to skip, the scheduler 112 determines the identity of the particular lines to be skipped as shown in step 342. Methods for selecting the particular lines to be skipped are explained below.

Figure 14:
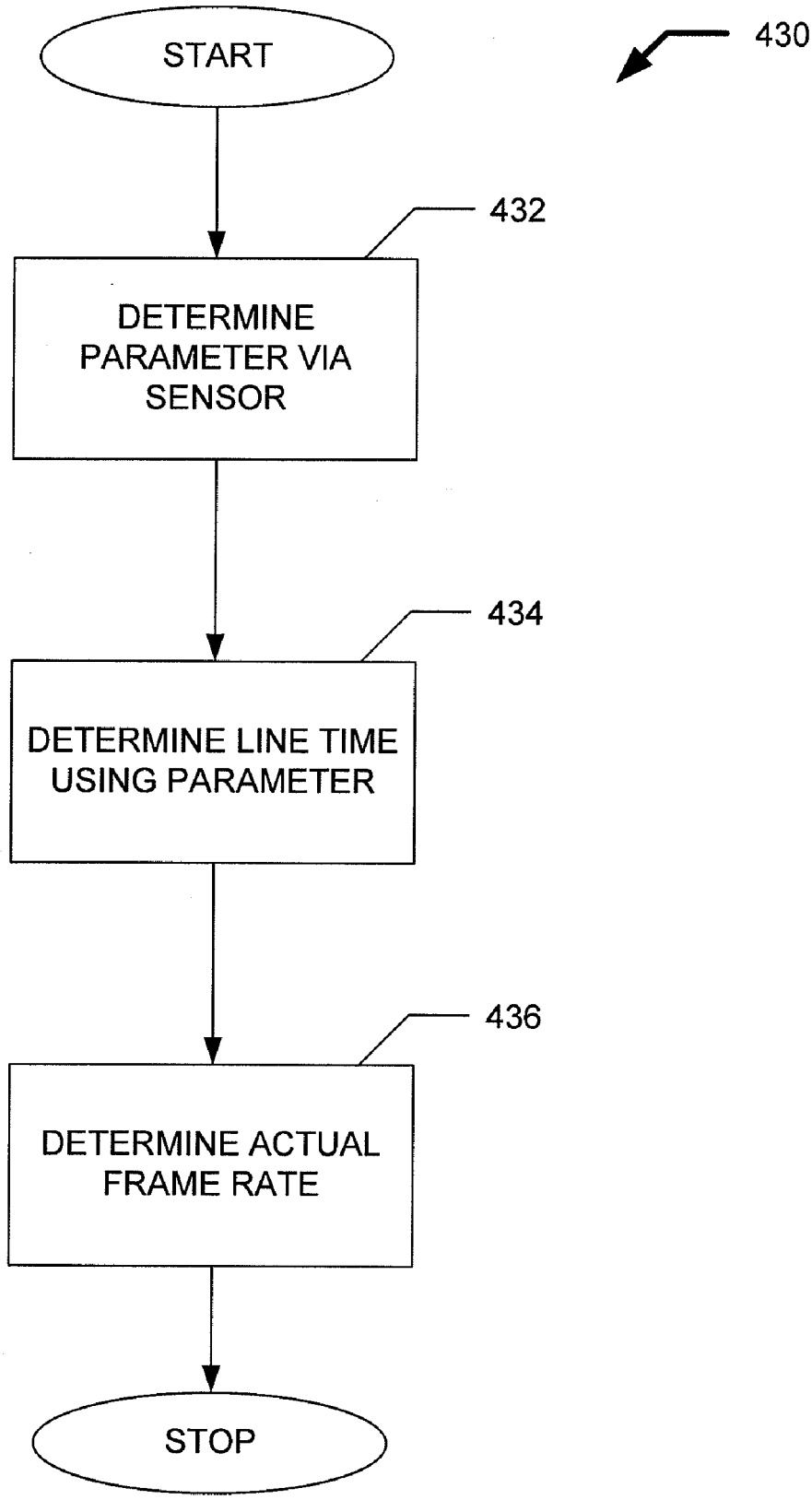
FIG. 14 is a flowchart illustrating one embodiment of a method for determining actual frame rate.

FIG. 14 is a flowchart illustrating one method for determining actual frame rate. This determination is reflected in step 334 of method 330 in FIG. 12. Depending on the embodiment, other steps may be added, certain steps removed, the steps rearranged, multiple steps be merged into a single step, or single steps broken into sub-steps. For ease of explanation, method 430 will be described in relation to display device 102 from FIG. 8. However, it will be appreciated that method of FIG. 12 may be practiced with system 150 of FIG. 9 or other embodiments herein described. Depending on the embodiment, other steps may be added, certain steps removed, the steps rearranged, multiple steps be merged into a single step, or single steps broken into sub-steps. In step 432, scheduler 112 determines a physical parameter of display device 102. In one example, this physical parameter is the temperature of display device 102. In alternative embodiments this parameter may be other characteristics such as humidity and atmospheric pressure. In step 432, scheduler 112 determines actual line time using the parameter. For example, where the parameter is temperature, scheduler 112 may use the temperature as an index to a look up table that contains previously measured information relating temperature to line time. This similar look up technique may also be used for other physical parameters. In another embodiment, scheduler 112 may measure line time more directly. For example, in U.S. patent application Ser. No. 12/369,679 entitled "Measurement And Apparatus For Electrical Measurement Of Electrical Drive Parameters For A Memes Based Display" and incorporated herein in its entirety, circuits are described for measuring the charge or current required to actuate MEMS devices. Those same circuits may be used to directly measure the line time. For example, in one embodiment, a voltage is applied across row and columns to place all the MEMS devices in the row into an un-actuated, baseline position. Next, a bias voltage is applied for a significant duration and the charge or current expended is measured. This first duration is long enough to ensure that the MEMS devices in the row are actuated. The measured charge is then used as an indication of the charge required to actuate the row. Next, the row is reset to an un-actuated position. This time the same voltage is applied for a shorter, but known, period of time and the charge accumulated is measured. After that period, the accumulated charge is compared to the charge required to actuate the entire row. This process is repeated several times with shorter and shorter voltage application windows. At some point, the charge accumulated during the voltage application window is less than the measured charge required to actuate the row. At that point, it is determined that actual line time must be greater than the length of the voltage application window during which the entire row did not actuate. In another embodiment, the scheduler 112 may use a fixed value for the line time. For example, the scheduler may assume that a particular display device has a line time of a fixed number of milliseconds, regardless of the operating conditions. This fixed value could be standard for all similar displays or might be individualized to the particular display device based upon analysis performed at some prior time. Whether approximated by relation to a fixed value or parameter or measured more directly, the line time is then used by scheduler 112 to determine the actual frame rate as shown in step 436. Again, while method 430 indicates that actual frame rate is calculated, actual line time may be used rather then actual frame rate in the methods described herein.

Figure 15:
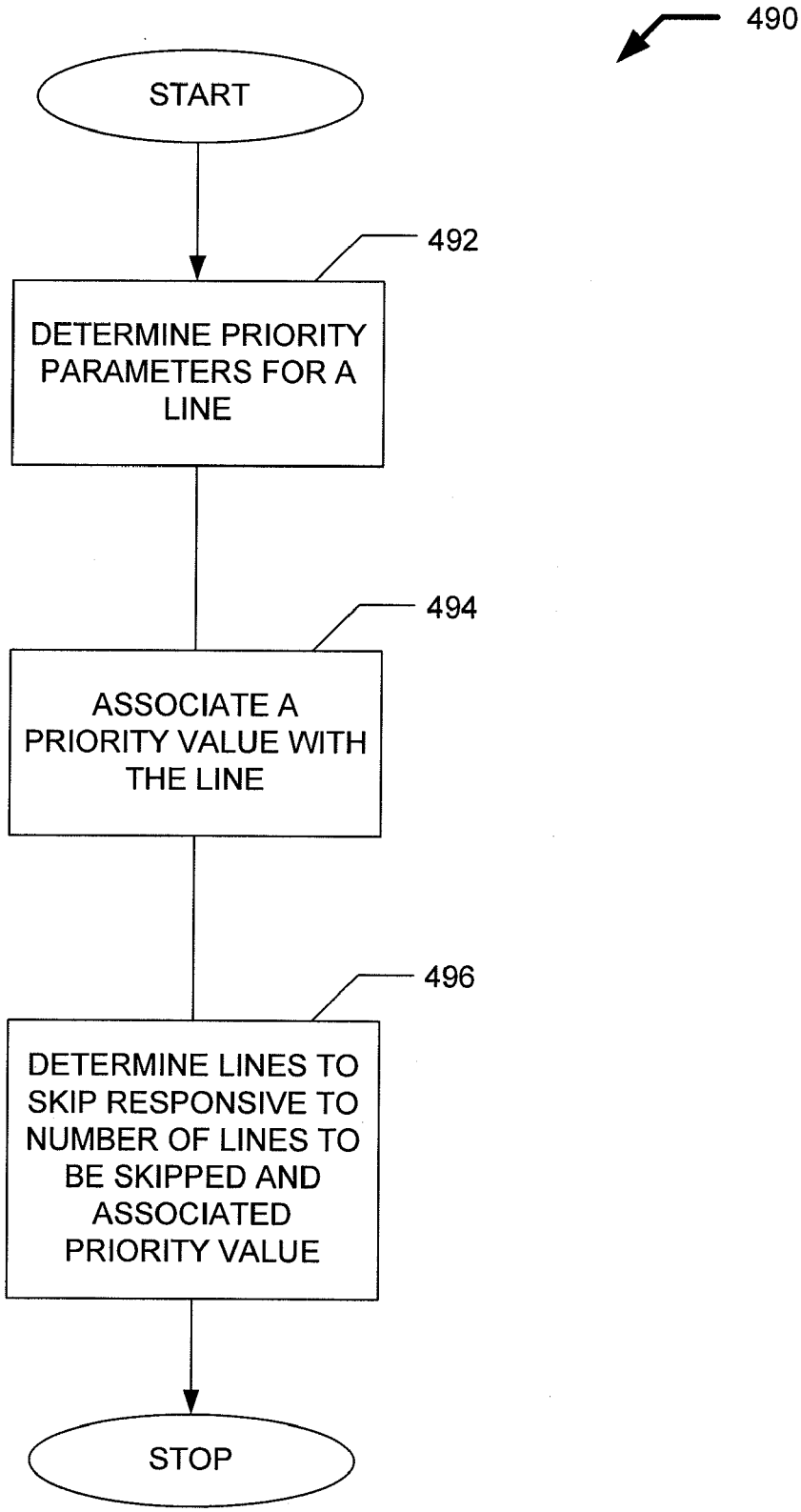
FIG. 15 is a flowchart illustrating one embodiment of a method for determining which lines to skip

FIG. 15 is a flowchart illustrating one method for determining which lines to skip. This determination is reflected in step 342 of method 330 in FIG. 12. Depending on the embodiment, other steps may be added, certain steps removed, the steps rearranged, multiple steps be merged into a single step, or single steps broken into sub-steps. For ease of explanation, method 490 will be described in relation to display device 102 from FIG. 8. However, it will be appreciated that method of FIG. 12 may be practiced with system 150 of FIG. 9 or other embodiments herein described. In step 492, scheduler 112 determines a priority parameter for each line of display data. In one embodiment, this priority parameter is determined relative to other lines of display data. Alternatively, the priority parameter may be an absolute value determined independently of the other lines of display data. One method for determining a priority parameter is to increment or decrement the priority of a particular line based on anticipated visual characteristics associated with skipping a particular line. Greater weight is given to the characteristics which have a greater affect on user experience or other criteria. For example, one characteristic may be the extent of the similarity of a line of display data to the corresponding line of data in the previous frame. Skipping the update for lines which have not changed significantly may have less visual effect than skipping lines which are drastically different from the same line in a preceding frame. Accordingly, lines which differ significantly from the corresponding line in previous frames may have a higher priority parameter for this similarity characteristic. For example, in one embodiment, if a line of data differs from a preceding line in a way such that 20 individual display devices in the corresponding row would have to be changed to update the row, a raw score of 20 is assigned for this similarity characteristic. As described below, this raw score may be scaled or further manipulated. Another characteristic is whether a particular line has been skipped during recent frame updates. Repeatedly skipping of the same line may have a larger negative visual effect than skipping different lines over a number of frame updates. Accordingly, lines which have been recently skipped may be given a higher priority for this characteristic. For example, in one embodiment, if a line has been skipped in the immediately preceding frame, a raw score of 10 is assigned to the line for this recently skipped characteristic. If the line has been skipped in the two immediately preceding frames, a raw score of 30 is assigned for this recently skipped characteristic. As described below, this raw score may be scaled or further manipulated. Another characteristic is the color of the line. The human eye may be more sensitive to certain frequencies of light as reflected by display elements 110. For example, skipping green lines may have a more negative effect on visual experience than skipping lines corresponding to other colors. Accordingly, lines which display the color green may be given a higher priority for this color characteristic. For example, in one embodiment, if the color corresponding to a particular line is green, the line is assigned a raw score of 10 for this color characteristic. Alternatively, if the color corresponding to a particular line is red, this line is assigned a raw score of 5 for this color characteristic. As described below, this raw score may be scaled or further manipulated. Another characteristic is the priority of other lines near a particular line. Skipping a large section of contiguous or nearby lines may have a more negative effect than skipping lines that are more spread out. Accordingly, if the lines nearby a particular are likely to be skipped, that particular line may be given a higher priority for this proximity characteristic. For example, in one embodiment, a line may be assigned a raw score for this proximity characteristic according to equation two described below:

$$(\text{Raw Proximity Score})=(\text{Raw Proximity Max})-((\text{Priority of Preceding Line})+(\text{Priority of Following Line})) \quad \text{Equation (2)}$$

Where:

Raw Proximity Score is an un-scaled priority value for a row in the display matrix related to the priority values of proximate rows in the display matrix.

Raw Proximity Max is an adjustable parameter used for increasing or decreasing priority relative to adjacent lines.

Priority of Preceding Line is a priority value from a preceding row in the display matrix.

Priority of Following Line is a priority value from a following row in the display matrix.

According to equation two, lower priority values in adjacent lines will result in a higher raw score for this proximity characteristic. In one example, the raw proximity max is set to a value of 100 and the priority of the preceding and following lines are each equal to 15. According to equation two this results in a raw proximity score of 70. As described below, this raw score may be scaled or further manipulated.

After raw characteristic scores have been determined for a line, a weighting function may be applied to determine and overall priority score. For example, in one embodiment, raw characteristic scores are weighted according to the equation three described below:

$$\text{(Overall Priority Score)}=A\text{(Raw Similarity Characteristic Score)}+B\text{(Raw Recently Skipped Characteristic Score)}+C\text{(Raw Color Characteristic Score)}+D\text{(Raw Proximity Characteristic Score)} \quad \text{Equation (3)}$$

Where:

Overall Priority Score is a priority value for a row in the display matrix during a particular update.

A-D are adjustable weighting coefficients.

Raw Similarity Score is an un-scaled priority value related to the extent of the similarity of a line of display data to the corresponding line of data in the previous frame.

Raw Recently Skipped Characteristic Score is an un-scaled priority value related to whether a particular line has been skipped during recent frame updates.

Raw Color Characteristic Score is an un-scaled priority value related to the color of light associated with a particular line.

Raw Proximity Characteristic Score is an un-scaled priority value for a row in the display matrix related to the priority values of proximate rows in the display matrix.

In equation three, coefficients A-D are weighting factors which can be manipulated to minimize visual artifacts from skipping lines. In one example, A is a value in the range of 0.1-0.3, B is a value in the range of 0.5-0.7, C is a value in the range of 0.2-0.4, and D is a value in the range of 0.05-0.1. Continuing to step 494, the scheduler 112 then associates the priority value with its corresponding line. For example, the priority and line pair may be stored in memory 116. In step 496, the scheduler 112 determines which lines will be skipped. In one embodiment, the scheduler 112 selects the lines to be skipped responsive to the number of lines to be skipped and the associated priority value. For example, if priority values are determined in a relative manner, the lines associated with the N lowest priority values are skipped, where N is greater than or equal to the number of lines to be skipped as determined in step 340 of FIG. 12. In another embodiment, priority values may be determined on an absolute scale. In this embodiment, the scheduler 112 may select a priority value X, and all lines associated priority value less than X are skipped, where the number of such lines is greater than or equal to the number of lines to be skipped as determined in step 340 of FIG. 12. In the context of FIG. 8, scheduler 112 may skip these lines by preventing the lines from being written to buffer 106. Alternatively, in the context of FIG. 9, scheduler 160 may skip these lines by preventing them from being driven by driver 156.

Figure 16:
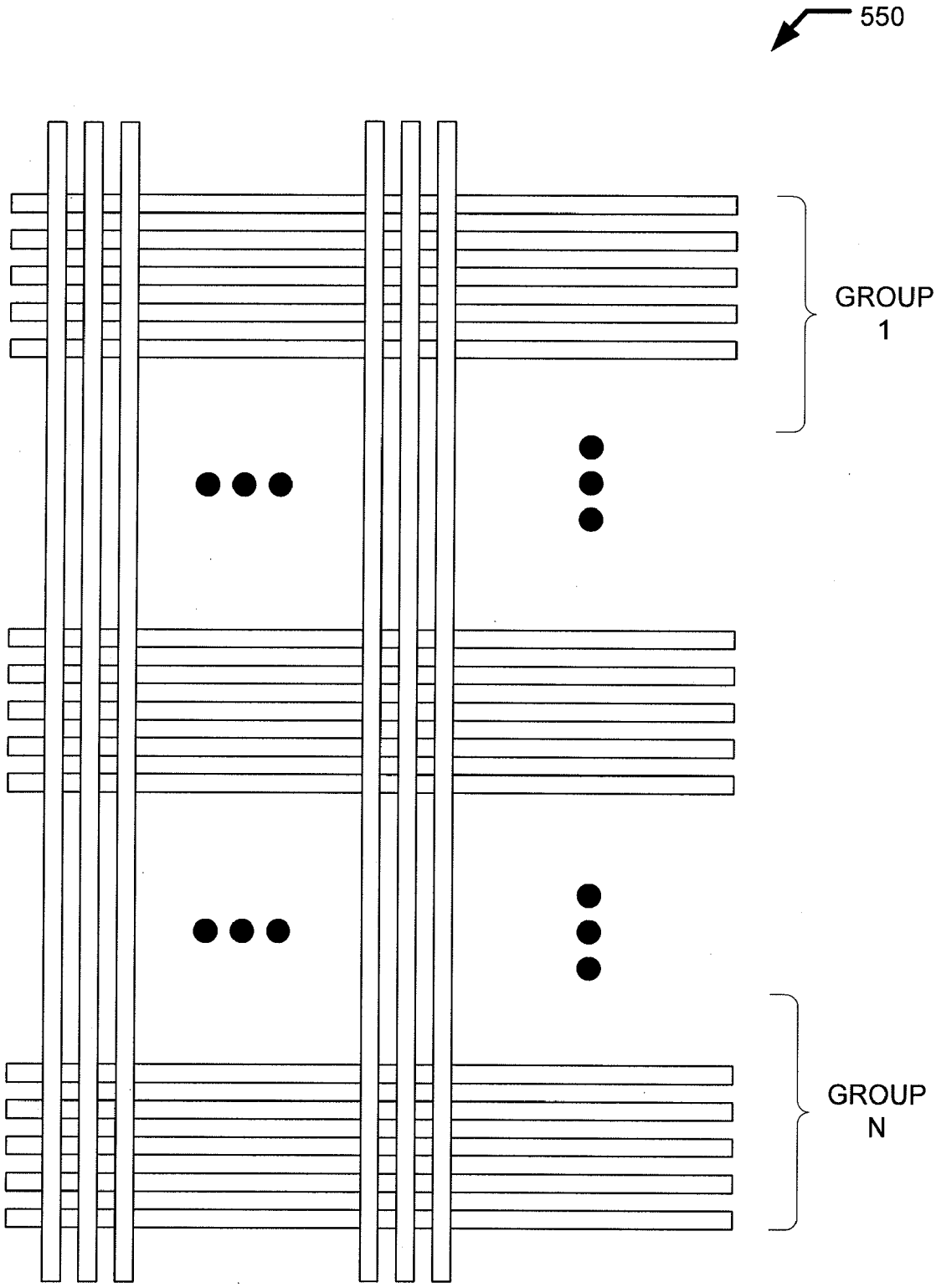
FIG. 16 is a flowchart illustrating a MEMS display device divided into a plurality of groups of rows

FIG. 16 illustrates a MEMS display which has been subdivided into a plurality of groups, each group comprising a number of rows. For ease of explanation, FIG. 16 will be described in relation to display device 102 from FIG. 8. However, it will be appreciated that display of FIG. 16 may be practiced with system 150 of FIG. 9 or other embodiments herein described. The methods described above have been described in relation to an entire matrix of MEMS devices. In another embodiment, the methods herein are applied to individual groups of rows within the display elements 110. For example, after determining an overall number of lines that must be skipped in a frame to achieve a desired frame rate, the overall number of lines to be skipped can be divided by the number of groups to determine the number of lines to be skipped per group. By requiring the skipped lines to fall approximately evenly between groups, the scheduler 112 can ensure that the skipped lines are spread out over the whole frame and not clumped together in one particular section. This spreading function can eliminate visual artifacts that might otherwise result from skipping large groupings of lines near each other. In addition, dividing a display into groups provides an opportunity for the scheduler 112 to periodically determine an effective frame rate. For example, the scheduler can determine the number of lines updated in a particular group to determine the effective frame rate of the display. Further, the scheduler 112 can ensure that this effective frame rate does exceed or fall short of certain pre-established bounds by forcing the driver to wait before proceeding to a subsequent group or by forcing more lines to be skipped in a particular group. For example, a group may consist of 32 lines and the required frame rate and actual line times may dictate that two lines per group must be skipped. If only half the lines in a group merit being updated based on their priorities, proceeding immediately to the next group after finishing the former group results in a high effective rate which may exceed the permissible limit. To compensate, the scheduler 112 may cause the driver 108 to idle until the effective frame rate is within the established bounds. Alternatively, if all the lines in a particular group must be updated, the effective frame rate may be too low. The scheduler 112 may compensate by using extra time form a preceding or following group to update the high priority lines in the particular group. By enforcing this bounded effective frame rate, the scheduler 112 can ensure that the required frame rate is met and that the rate at which the driver 108 requests data from the buffer 106 does not exceed the rate at which the host 104 provides data to the buffer 106.

While the above detailed description has shown, described, and pointed out novel features as applied to various embodiments, it will be understood that various omissions, substitutions, and changes in the form and details of the device or process illustrated may be made by those skilled in the art without departing from the spirit of the invention. As will be recognized, the invention may be embodied within a form that does not provide all of the features and benefits set forth herein, as some features may be used or practiced separately from others.

What is claimed is:

1. A method of operating a bi-stable display, the method comprising:

determining a drive schedule for a plurality of bi-stable display elements arranged in a plurality of rows and columns, wherein determining the drive schedule includes setting a priority for each row or column of a plurality of the rows or columns; and determining for each row or column individually whether to display the row or column based upon the priorities of the rows or columns.

2. The method of claim 1, wherein determining the drive schedule comprises determining a desired display update rate.

3. The method of claim 2, wherein determining the drive schedule further comprises:

determining an actual display update rate capability; and comparing the actual display update rate capability to the desired display update rate.

4. The method of claim 3, further comprising determining a number of the rows or columns, which, when skipped, cause the actual display rate capability to be equal to or exceed the desired display update rate.

5. The method of claim 3, wherein determining the actual display update rate capability comprises determining an amount of time required to update a row or column.

6. The method of claim 5, wherein determining the amount of time required to update the row or column further comprises:

detecting a physical parameter; and estimating the amount of time required to update the row or column based, at least in part, on the physical parameter.

7. The method of claim 6, wherein the physical parameter is a temperature.

8. The method of claim 6, wherein the physical parameter is an actuation voltage of one or more of the plurality of bi-stable display elements.

9. The method of claim 5, wherein determining the amount of time required to update the row or column further comprises:

measuring an accumulated charge applied to the row or column over a known period of time; and comparing the accumulated charge to a known quantity of charge required to actuate the row or column.

10. The method of claim 5, wherein determining the amount of time required to update the row or column further comprises accessing a fixed time value associated with one or more of the plurality of bi-stable display elements.

11. The method of claim 1, further comprising determining a number of rows or columns to skip.

12. The method of claim 11, further comprising:

dividing the plurality of rows and columns into a plurality of groups; and dividing the number of the rows or columns to skip among the plurality of groups.

13. The method of claim 12, wherein the number of the rows or columns allotted to each group is approximately even.

14. The method of claim 1, wherein the priority value for at least one row or column is determined based, at least in part, on a number of times the at least one of the rows row or column has been skipped during one or more previous display updates.

15. The method of claim 14, wherein the priority value for at least one row or column is determined based, at least in part, on a color of light associated with the at least one row or column.

16. The method of claim 14, wherein the priority value for at least one row or column is determined based, at least in part, on a priority value associated with another row or column that is adjacent to the at least one row or column.

17. A bi-stable display system, the system comprising:

a display comprising a plurality of bi-stable elements arranged in a plurality of rows and columns; and a processor configured to communicate with said display, said processor being configured to determine a drive schedule for the rows and columns, wherein determining the drive schedule setting a priority for each row or column of a plurality of the rows or columns, and to determine for each row or column individually whether to display the row or column or to skip the row or column based upon the priorities of the rows or columns.

18. The system of claim 17, wherein the processor is further configured to determine a desired display update rate.

19. The system of claim 18, wherein the processor is further configured to:

determine an actual display update rate capability; and compare the actual display update rate capability to the desired display update rate.

20. The system of claim 19, wherein the processor is further configured to determine an amount of time required to update a row or column.

21. The system of claim 20, wherein the processor is further configured to:

detect a physical parameter; and estimate the amount of time required to update the row or column based, at least in part, on the physical parameter.

22. The system of claim 21, wherein the physical parameter is a temperature.

23. The system of claim 21, wherein the physical parameter is an actuation voltage of one or more of the plurality of bi-stable display elements.

24. The system of claim 20, wherein the processor is further configured to:

measure an accumulated charge applied to the row or column over a known period of time; and compare the accumulated charge to a known quantity of charge required to actuate the row or column.

25. The system of claim 20, wherein the processor is further configured to access a fixed time value associated with one or more of the plurality of bi-stable display elements.

26. The system of claim 17, wherein the processor is further configured to determine a number of the rows or columns, which, when skipped, cause the actual display rate capability to be equal to or exceed the desired display update rate.

27. The system of claim 17, wherein the processor is further configured to determine a number of rows or columns to skip.

28. The system of claim 27, wherein the processor is further configured to:

divide the plurality of rows and columns into a plurality of groups; and divide the number of the rows or columns to skip among the plurality of groups.

29. The system of claim 28, wherein the number of the rows or columns allotted to each group is approximately even.

30. The system of claim 17, wherein the priority value for at least one row or column is determined based, at least in part, on a number of times the at least one row or column has been skipped during one or more previous display updates.

31. The system of claim 17, wherein the priority value for at least one row or column is determined based, at least in part, on a color of light associated with the at least one row or column.

32. The system of claim 17, wherein the priority value for at least one row or column is determined based, at least in part, on a priority value associated with another row or column that is adjacent to the at least one row or column.

33. The system of claim 17, further comprising:

a second processor that is configured to communicate with said display, said second processor being configured to process image data; and a memory device that is configured to communicate with said second processor.

34. The system of claim 33, further comprising a driver circuit configured to send at least one signal to said display.

35. The system of claim 34, further comprising a controller configured to send at least a portion of said image data to said driver circuit.

36. The system of claim 33, further comprising an image source module configured to send said image data to said second processor.

37. The system of claim 36, wherein said image source module comprises at least one of a receiver, transceiver, and transmitter.

38. The system of claim 33, further comprising an input device configured to receive input data and to communicate said input data to said second processor.

39. A bi-stable display system, the system comprising:

means for displaying display data; and means for determining a drive schedule for updating the display means, wherein determining the drive schedule includes setting a priority for each row or column of a plurality of the rows or columns; and means for determining for each row or column individually whether to display the row or column or to skip the row or column based on the priorities of the rows or columns.

40. The system of claim 39, wherein:

the display means comprises a plurality of bi-stable elements arranged in a plurality of rows and columns; and the determining means comprises a processor.

* * * * *